US011773737B1

(12) United States Patent
Whittle et al.

(10) Patent No.: US 11,773,737 B1
(45) Date of Patent: Oct. 3, 2023

(54) LOAD TRANSFER DEVICE, STATOR VANE ASSEMBLY, TURBINE, AND GAS TURBINE ENGINE INCLUDING THE SAME

(71) Applicant: Rolls-Royce PLC, London (GB)

(72) Inventors: Michael John Whittle, Caldicot (GB); Donka Novovic, Birmingham (GB); James William Philip Montgomery, Derby (GB)

(73) Assignee: Rolls-Royce PLC

( * ) Notice: Subject to any disclaimer, the term of this patent is extended or adjusted under 35 U.S.C. 154(b) by 0 days.

(21) Appl. No.: 17/733,135

(22) Filed: Apr. 29, 2022

(51) Int. Cl.
*F01D 9/04* (2006.01)
*F01D 11/00* (2006.01)

(52) U.S. Cl.
CPC ..... *F01D 9/042* (2013.01); *F01D 11/005* (2013.01); *F05D 2240/11* (2013.01); *F05D 2300/20* (2013.01)

(58) Field of Classification Search
CPC . F01D 9/04; F01D 9/042; F01D 9/044; F01D 11/08; F01D 25/005; F05D 2240/11; F05D 2240/12
See application file for complete search history.

(56) References Cited

U.S. PATENT DOCUMENTS

| | | | | |
|---|---|---|---|---|
| 7,452,189 | B2 | 11/2008 | Shi et al. | |
| 10,100,649 | B2 * | 10/2018 | Thomas | F01D 25/246 |
| 10,808,560 | B2 * | 10/2020 | Sippel | F01D 9/065 |
| 2016/0123163 | A1 | 5/2016 | Freeman et al. | |
| 2016/0177761 | A1 | 6/2016 | Huizenga et al. | |
| 2016/0290147 | A1 | 10/2016 | Weaver | |
| 2020/0080429 | A1 * | 3/2020 | Vetters | F01D 11/08 |

* cited by examiner

*Primary Examiner* — David E Sosnowski
*Assistant Examiner* — Maxime M Adjagbe
(74) *Attorney, Agent, or Firm* — Barnes & Thornburg LLP

(57) ABSTRACT

A stator vane assembly for a gas turbine engine is disclosed. The stator vane assembly includes an inner carrier including a metallic material and an outer carrier including a metallic material. The stator vane assembly further includes a ceramic-containing airfoil that extends from the inner carrier to the outer carrier and is at least partially received by the inner carrier and the outer carrier. The stator vane assembly further includes a load transfer device disposed between the airfoil and at least one of the inner carrier and the outer carrier. The load transfer device includes a support member fixedly attached to the at least one of the inner carrier and the outer carrier, and a plurality of micropillars coupled to the support member and extending towards the airfoil. Each micropillar is deformable and engages the airfoil.

18 Claims, 18 Drawing Sheets

LOAD TRANSFER DEVICE, STATOR VANE ASSEMBLY, TURBINE, AND GAS TURBINE ENGINE INCLUDING THE SAME

FIELD OF THE DISCLOSURE

The present disclosure relates generally to gas turbine engines, and more specifically to a load transfer device, a stator vane assembly including the load transfer device, a turbine of a gas turbine engine including the load transfer device, and a gas turbine engine including the load transfer device.

BACKGROUND

Gas turbine engines may be used to power aircraft, watercraft, power generators, and the like. A gas turbine engine typically includes a compressor, a combustor, and a turbine. The compressor compresses air drawn into the gas turbine engine and delivers high pressure air to the combustor. In the combustor, a fuel is mixed with the high pressure air and is ignited. Combustion products of the combustion in the combustor are directed into the turbine where work is extracted to drive the compressor, and sometimes, an output shaft. Left-over combustion products of the combustion are exhausted out of the turbine and may provide thrust in some applications.

Due to high operating temperatures within the gas turbine engine, it may be desirable to utilize materials with low coefficient of thermal expansion. For example, to operate effectively in such strenuous temperature and pressure conditions, composite materials, such as ceramic matrix composite (CMC) materials, may be used.

The gas turbine engine may include components that engage with each other and are made from different materials having different coefficients of thermal expansion. For example, a first component may be made from a ceramic or CMC material and a second component that engages the first component may be made from a metallic material. Due to the different coefficients of thermal expansion of the different materials, the components may expand at different rates when exposed to the combustion products. As a result, coupling such components with traditional fasteners, such as rivets or bolts, may not allow for differing levels of expansion and contraction during operation of the gas turbine engine. Moreover, such CMC materials have mechanical properties that may have to be considered during the design and application of the CMC. For example, CMC materials may have relatively low tensile ductility or low strain to failure as compared to metallic materials. These low tensile ductility or low strain to failure characteristics may require special fastening arrangements to secure them in position within the gas turbine engine.

Therefore, there is a need to reduce stresses induced in low strength/low strain components made from a ceramic material to improve their operational lifespan.

SUMMARY OF THE DISCLOSURE

According to an aspect of the present disclosure, a stator vane assembly for a gas turbine engine is provided. The stator vane assembly includes an inner carrier including a metallic material. The stator vane assembly further includes an outer carrier including a metallic material. The stator vane assembly further includes a ceramic-containing airfoil that extends from the inner carrier to the outer carrier and is at least partially received by the inner carrier and the outer carrier. The stator vane assembly further includes a load transfer device disposed between the ceramic-containing airfoil and at least one of the inner carrier and the outer carrier. The load transfer device includes a support member fixedly attached to the at least one of the inner carrier and the outer carrier. The load transfer device further includes a plurality of micropillars coupled to the support member and extending towards the ceramic-containing airfoil. Each micropillar is deformable and engages the ceramic-containing airfoil.

According to another aspect of the present disclosure, a turbine for a gas turbine engine having a rotational axis is provided. The turbine includes a stator vane assembly. The stator vane assembly includes an inner carrier including a metallic material. The stator vane assembly further includes an outer carrier including a metallic material. The stator vane assembly further includes a ceramic-containing airfoil that extends from the inner carrier to the outer carrier and is at least partially received by the inner carrier and the outer carrier. The stator vane assembly further includes a first load transfer device disposed between the ceramic-containing airfoil and at least one of the inner carrier and the outer carrier. The first load transfer device includes a support member fixedly attached to the at least one of the inner carrier and the outer carrier. The first load transfer device further includes a plurality of micropillars coupled to the support member and extending towards the ceramic-containing airfoil. Each micropillar is deformable and engages the ceramic-containing airfoil. The turbine further includes a rotor blade axially spaced apart from the stator vane assembly with respect to the rotational axis. The turbine further includes a turbine shroud assembly circumferentially encasing the rotor blade with respect to the rotational axis.

According to another aspect of the present disclosure, a gas turbine engine is provided. The gas turbine engine includes a first component including a metallic material. The gas turbine engine further includes a second component coupled to the first component. The second component includes a ceramic material. The gas turbine engine further includes a load transfer device disposed between the first component and the second component. The load transfer device includes a plurality of micropillars coupled to the first component and extending towards the second component. Each micropillar is deformable and engages the second component.

The skilled person will appreciate that except where mutually exclusive, a feature or parameter described in relation to any one of the above aspects may be applied to any other aspect. Furthermore, except where mutually exclusive, any feature or parameter described herein may be applied to any aspect and/or combined with any other feature or parameter described herein.

BRIEF DESCRIPTION OF THE DRAWINGS

Embodiments will now be described by way of example only, with reference to the Figures, in which.

DETAILED DESCRIPTION

Aspects and embodiments of the present disclosure will now be discussed with reference to the accompanying figures. Further aspects and embodiments will be apparent to those skilled in the art.

Figure 1:
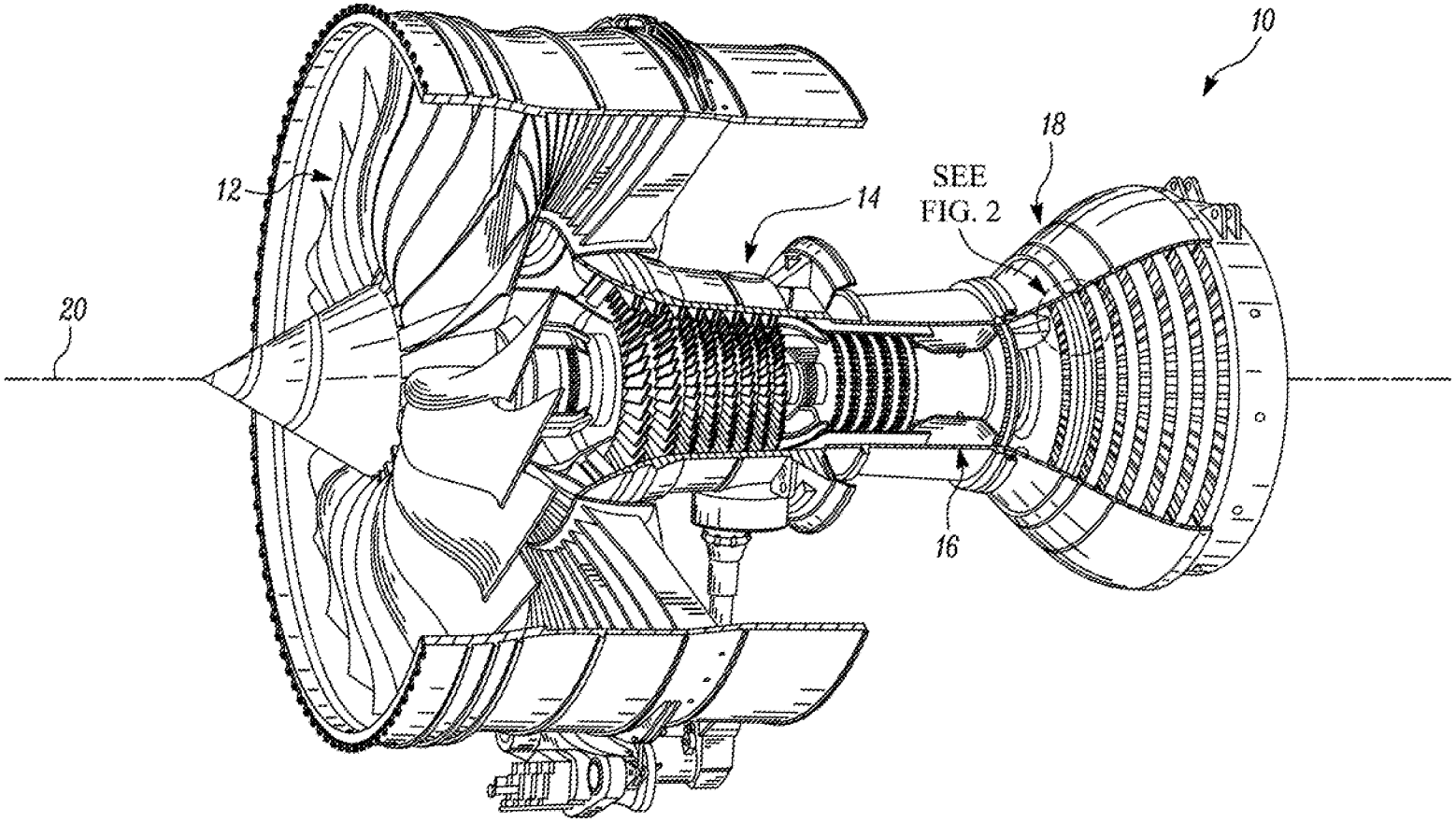
FIG. 1 is a schematic cutaway perspective view of a gas turbine engine.

FIG. 1 shows a schematic cut-away perspective view of an illustrative aerospace gas turbine engine 10 including a fan 12, a compressor 14, a combustor 16, and a turbine 18. The fan 12 is driven by the turbine 18 and provides thrust for propelling an air vehicle (not shown). The compressor 14 compresses and delivers air to the combustor 16. The combustor 16 mixes a fuel with the compressed air received from the compressor 14 and ignites the fuel. Hot, high-pressure combustion products of the combustion reaction in the combustor 16 are directed into the turbine 18 to cause the turbine 18 to rotate about a rotational axis 20 and drive the compressor 14 and the fan 12. Specifically, the gas turbine engine 10 has the rotational axis 20. Further, the compressor 14 and the fan 12 rotate about the rotational axis 20.

Figure 2:
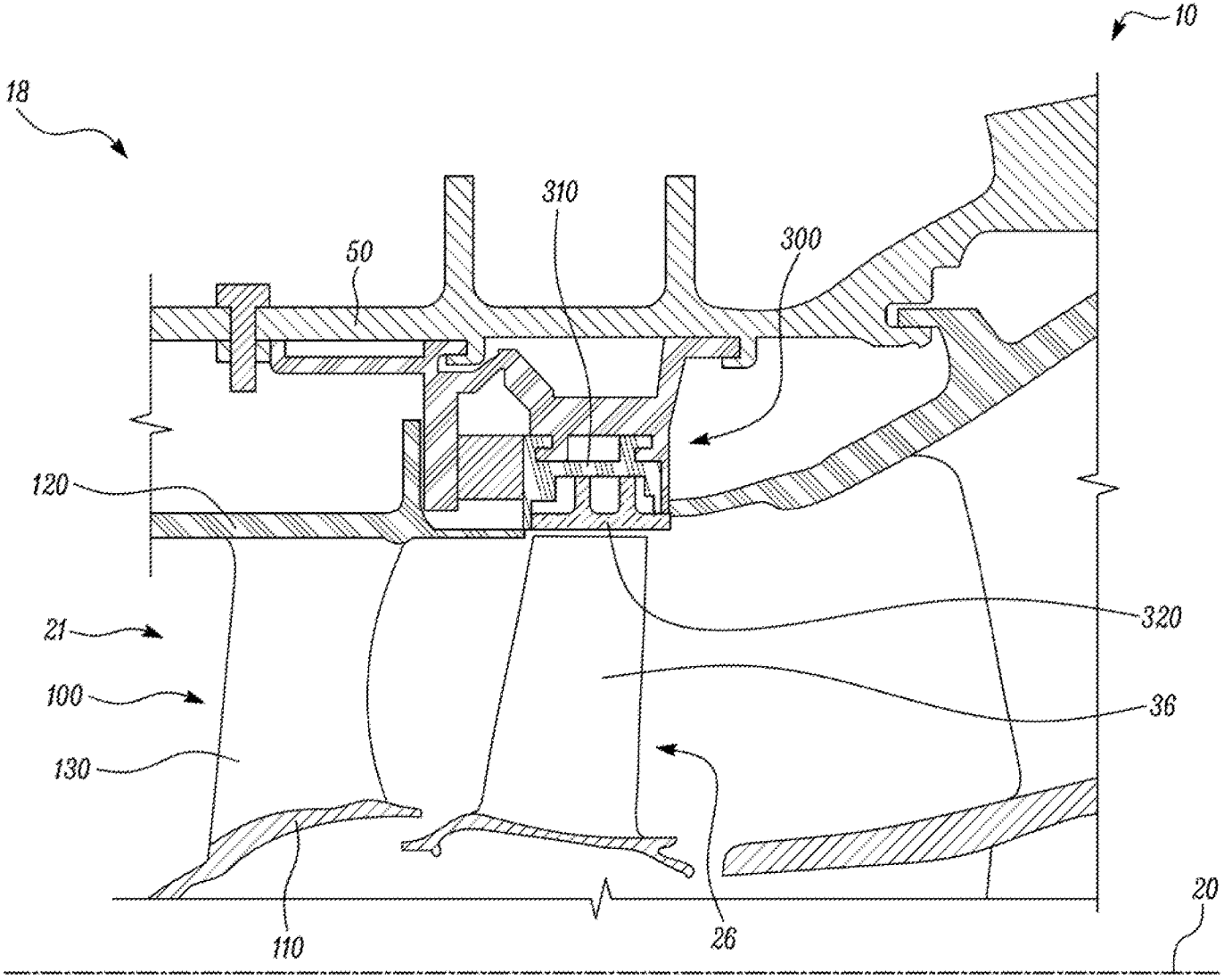
FIG. 2 is a schematic partial cross-sectional view of the gas turbine engine of FIG. 1.

FIG. 2 shows a schematic cross-sectional view of a portion of the turbine 18. Referring to FIGS. 1 and 2, the turbine 18 includes a stator vane ring 21 and a turbine wheel assembly 26 axially spaced apart from the stator vane ring 21 with respect to the rotational axis 20. The turbine wheel assembly 26 includes a rotor blade 36, specifically, a plurality of rotor blades 36 circumferentially spaced apart from one another about the rotational axis 20.

The stator vane ring 21 extends across a flow path of the hot, high-pressure combustion products from the combustor 16 to direct combustion products towards the plurality of rotor blades 36 of the turbine wheel assembly 26. The plurality of rotor blades 36 are in turn pushed by the hot, high-pressure combustion products to cause the turbine wheel assembly 26 to rotate, thereby driving the fan 12 and rotating components of the compressor 14.

Figure 3:
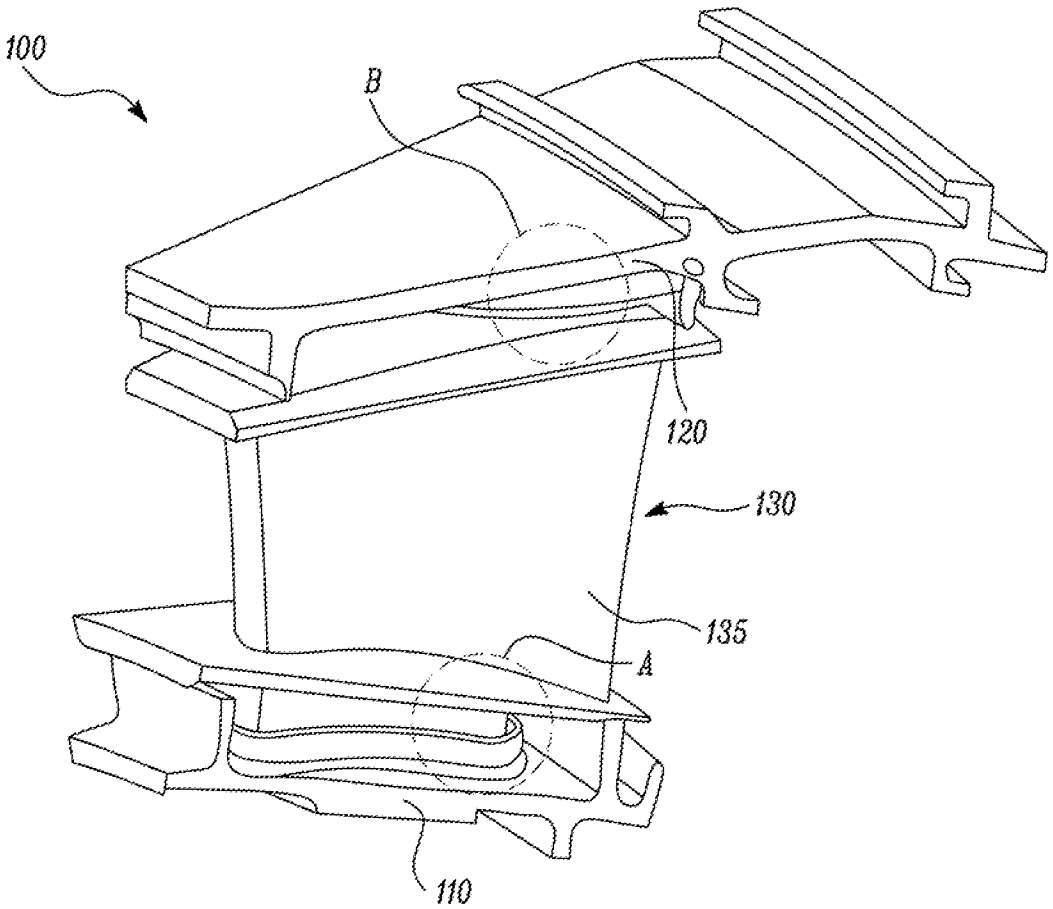
FIG. 3 is a schematic perspective view of a stator vane assembly of the gas turbine engine according to an embodiment of the present disclosure.

The stator vane ring 21 is illustratively made up of a plurality of individual stator vane assemblies 100, as shown in FIG. 3. The stator vane assemblies 100 are arranged circumferentially adjacent to one another to form an annular ring that extends around the rotational axis 20. Further, the rotor blade 36 is axially spaced apart from the stator vane assembly 100 with respect to the rotational axis 20.

Referring to FIGS. 2 and 3, each stator vane assembly 100 includes an inner carrier 110, an outer carrier 120, and a ceramic-containing airfoil 130 (interchangeably referred to as "the airfoil 130") that extends from the inner carrier 110 to the outer carrier 120. The airfoil 130 may have an aerodynamic shape, such that the airfoil 130 directs the combustion products from the combustor 16 (shown in FIG. 1) towards the plurality of rotor blades 36 of the turbine wheel assembly 26. In the illustrated embodiment of FIG. 3, the stator vane assembly 100 includes one airfoil 130. However, in some other embodiments, the stator vane assembly 100 may include more than one airfoil 130. A plurality of airfoils 130 extend annularly around the rotational axis 20 to direct the combustion products as described above.

In the present embodiment, the airfoil 130 is made from a ceramic material in order to withstand high pressure and temperature applied by the hot, high-pressure combustion products from the combustor 16 (shown in FIG. 1). Ceramic-containing components, like the airfoil 130, may withstand extremely high operating temperatures that may not be possible for metallic components. In some embodiments, the airfoil 130 may be made from a ceramic matrix composite (CMC). In some embodiments, the airfoil 130 may be made from a SiC—SiC ceramic matrix composite including a silicon carbide matrix and silicon carbide fibers. For purposes of the present disclosure, a ceramic material is any monolithic ceramic or composite in which at least one constituent is a ceramic.

The airfoil 130 is at least partially received by the inner carrier 110 and the outer carrier 120. Specifically, the airfoil 130 may be at least partially received within the inner carrier 110 and the outer carrier 120. Each of the inner carrier 110 and the outer carrier 120 may include suitable features to at least partially receive the airfoil 130 therein. For example, the inner carrier 110 and the outer carrier 120 may include coupling apertures configured to receive respective coupling portions of the airfoil 130. The airfoil 130 further includes an outer surface 135.

The airfoil 130 may transfer loads (e.g., aerodynamic loads) to the inner carrier 110 and the outer carrier 120. The inner carrier 110 and the outer carrier 120 may be directly or indirectly coupled to an engine casing of the gas turbine engine 10 in order to transfer the loads received from the airfoil 130 to the engine casing. For example, the inner carrier 110 may be coupled to a combustor case (not shown) to transfer the loads to the combustor case. In another example, the outer carrier 120 may be coupled to a turbine case 50 to transfer the loads to the turbine case 50.

The inner carrier 110 includes a metallic material. Furthermore, the outer carrier 120 includes a metallic material. Each of the inner carrier 110 and the outer carrier 120 may be interchangeably referred to as "a first component" that includes a metallic material. The metallic material may include a metal or a metal alloy. In some examples, the metallic material includes a material capable of maintaining its strength and shape at high temperatures, such as aluminum, titanium, nickel, cobalt, and the like, and alloys thereof. As discussed above, the airfoil 130 is made from a ceramic material. The airfoil 130 may be interchangeably referred to as "a second component" that includes a ceramic material.

Consequently, there may be a significant coefficient of thermal expansion mismatch between the airfoil 130 and each of the inner carrier 110 and the outer carrier 120. As a result, the inner carrier 110 and the outer carrier 120 may apply expansion loads on the airfoil 130 due to high operating temperatures within the gas turbine engine 10 (shown in FIG. 1). The loads (e.g., expansion loads, aerodynamic loads, etc.) may induce considerable stresses in the airfoil 130 and may significantly reduce an operational life expectancy of the airfoil 130 (as the airfoil 130 is made from strain intolerant ceramic materials).

To mitigate undesirable effects of the loads, the stator vane assembly 100 further includes a load transfer device 140 (shown in FIGS. 4 and 5) disposed between the airfoil 130 and at least one of the inner carrier 110 and the outer carrier 120. In other words, the load transfer device 140 is disposed between the first component and the second component. The load transfer device 140 may be interchangeably referred to as "the first load transfer device 140". The load transfer device 140 may be disposed between the outer surface 135 and the inner carrier 110 or between the outer surface 135 and the outer carrier 120.

In some embodiments, the stator vane assembly 100 further includes a plurality of the load transfer devices 140. The plurality of the load transfer devices 140 may be disposed between the outer surface 135 and the inner carrier 110, between the outer surface 135 and the outer carrier 120, or between the outer surface 135 and each of the inner carrier 110 and the outer carrier 120. In some embodiments, at least one load transfer device 140 from the plurality of the load transfer devices 140 is disposed between the airfoil 130 and the inner carrier 110, and at least one other load transfer device 140 from the plurality of the load transfer devices 140 is disposed between the airfoil 130 and the outer carrier 120. Exemplary locations of the load transfer device(s) 140 are indicated by dashed circles in FIG. 3. For example, the at least one load transfer device 140 from the plurality of the load transfer devices 140 may be disposed between the airfoil 130 and the inner carrier 110 in a first region A (shown by a dashed circle), and the at least one other load transfer device 140 from the plurality of the load transfer devices 140 may be disposed between the airfoil 130 and the outer carrier 120 in a second region B (shown by a dashed circle). Although not illustrated in FIG. 2 or 3, alternative embodiments include configurations where multiple load transfer devices 140 may be disposed between the outer surface 135 and either or both of the inner carrier 110 and the outer carrier 120.

Figure 4:
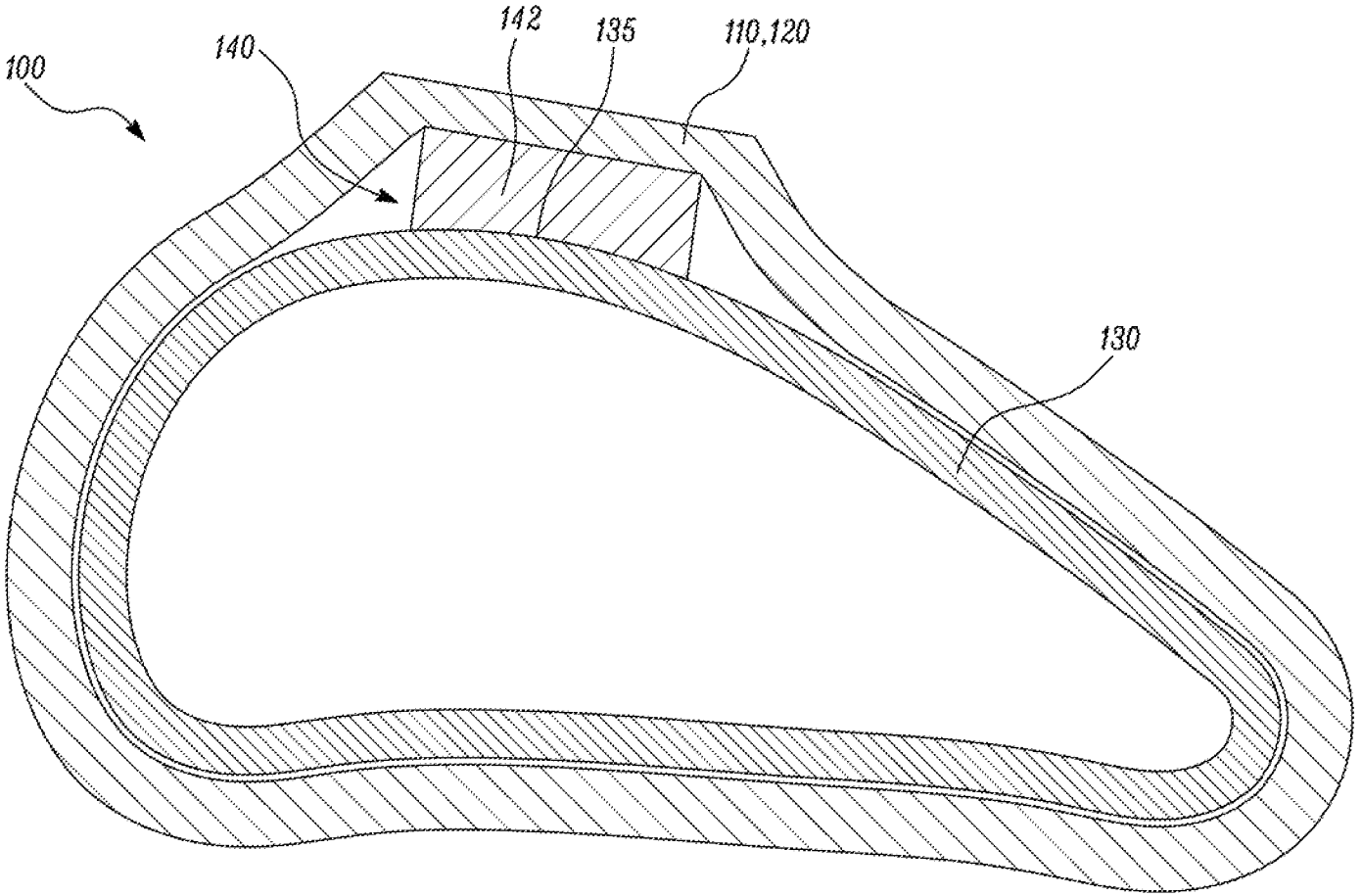
FIG. 4 is a schematic cross-sectional view of a portion of the stator vane assembly according to an embodiment of the present disclosure.
Figure 5:
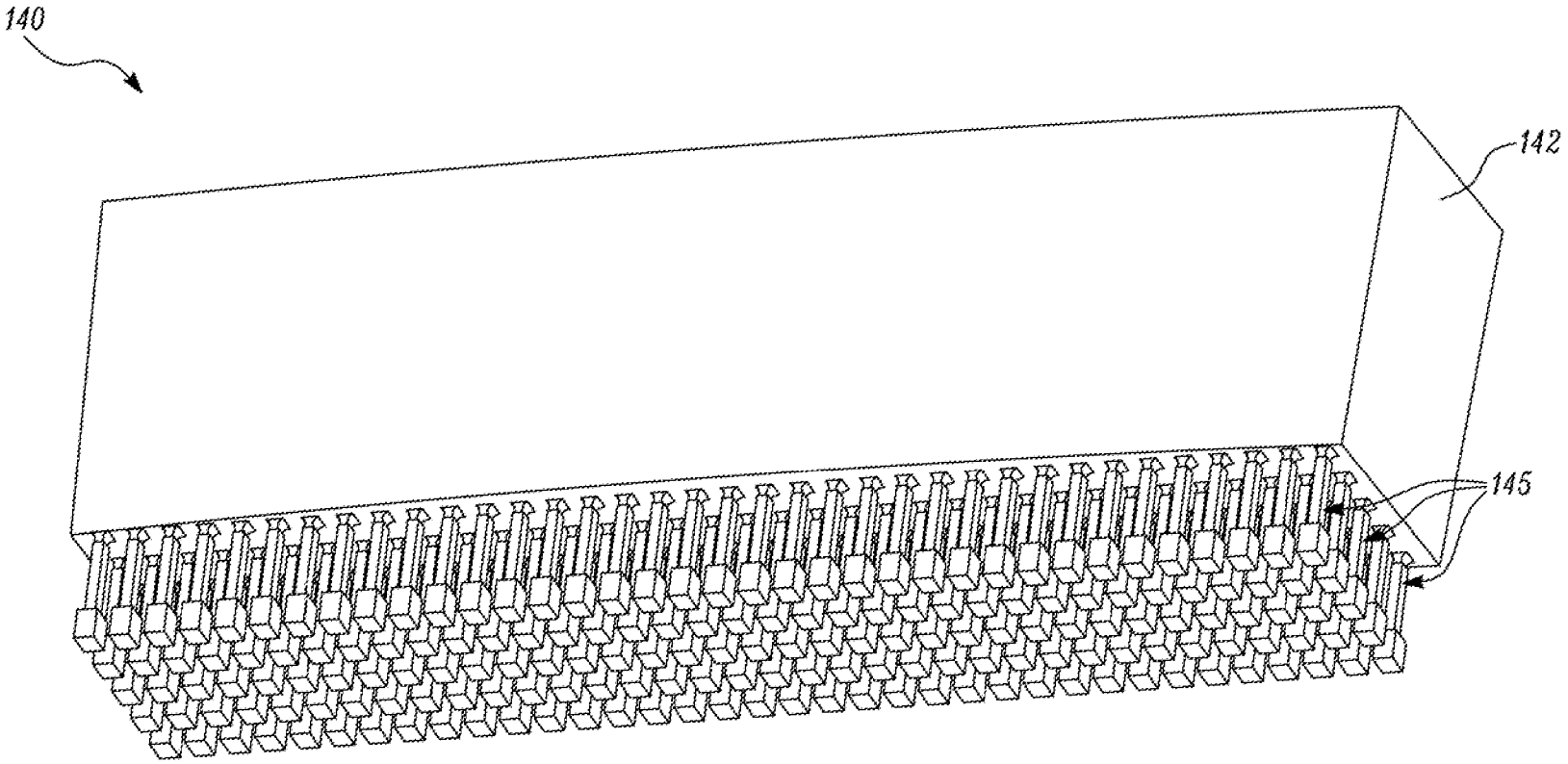
FIG. 5 is a schematic bottom perspective view of a load transfer device of the stator vane assembly of FIG. 4 according to an embodiment of the present disclosure.

Referring now to FIGS. 4 and 5, the load transfer device 140 includes a support member 142 fixedly attached to the at least one of the inner carrier 110 and the outer carrier 120. The support member 142 may be directly or indirectly attached to the at least one of the inner carrier 110 and the outer carrier 120. In the illustrated embodiment of FIG. 4, the support member 142 engages the at least one of the inner carrier 110 and the outer carrier 120. In other words, in the illustrated embodiment of FIG. 4, the support member 142 is directly attached to and engages the at least one of the inner carrier 110 and the outer carrier 120.

The load transfer device 140 further includes a plurality of micropillars 145 (shown in FIG. 5) coupled to the support member 142 and extending towards the airfoil 130. In some examples, the plurality of micropillars 145 may be coupled to the support member 142 by various methods, such as welding, adhesives, tongue and groove joint, mechanical fasteners, and so forth. In some other examples, the plurality of micropillars 145 may be integrally manufactured with the support member 142, e.g., through additive manufacturing processes as discussed in more detail below. The plurality of micropillars 145 is not shown in FIG. 4 for clarity purposes. Further, the inner carrier 110/the outer carrier 120, the support member 142, and the airfoil 130 are cross-hatched in FIG. 4 for clarity purposes. Each micropillar 145 is deformable and engages the airfoil 130. Specifically, each micropillar 145 is deformable and may engage the outer surface 135 of the airfoil 130. As shown in FIG. 4, the outer surface 135 of the airfoil 130 may have an unmachined and non-planar profile. In such cases, the plurality of micropillars 145 may be designed to match the unmachined and non-planar profile of the outer surface 135.

Figure 6B:
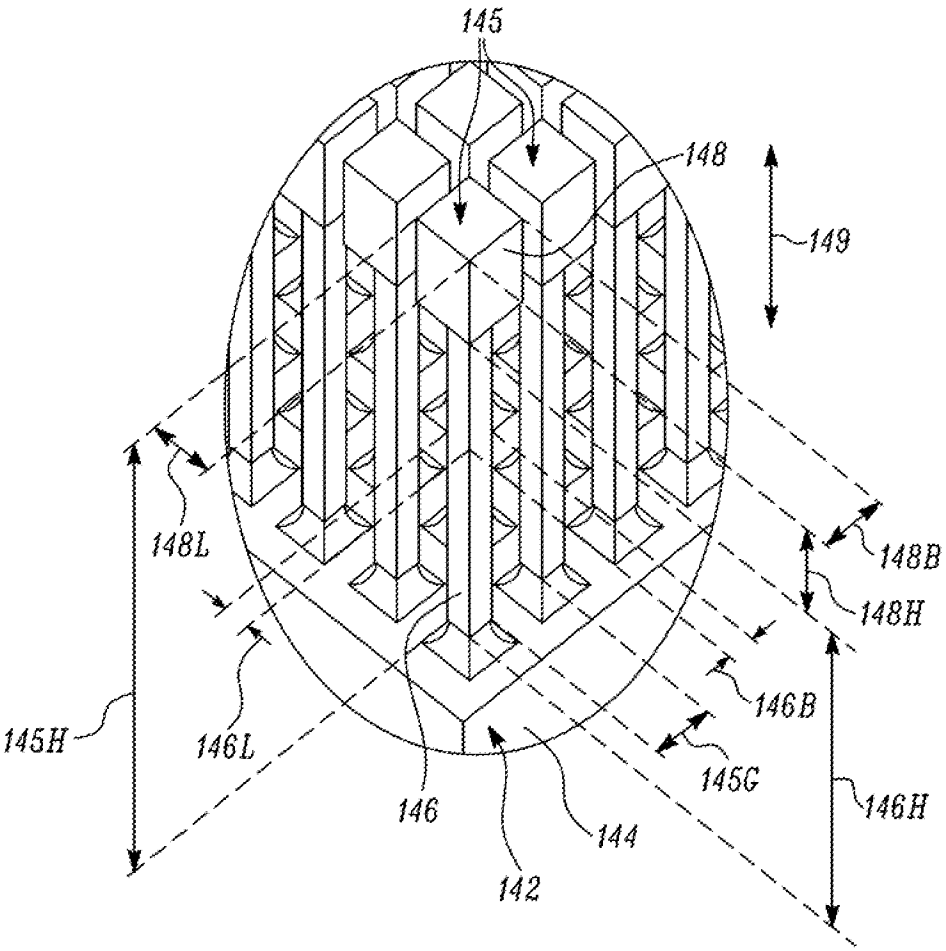
FIG. 6B is a schematic magnified view of a portion of the load transfer device of FIG. 6A.
Figure 6A:
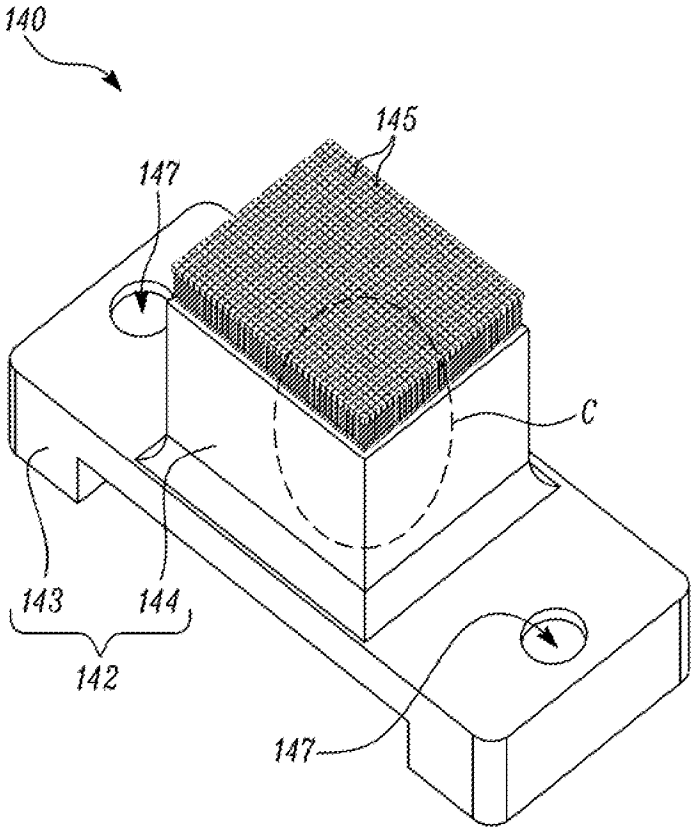
FIG. 6A is a schematic top perspective view of the load transfer device according to another embodiment of the present disclosure.

FIG. 6A shows a top perspective view of the load transfer device 140 according to another embodiment of the present disclosure. Further, FIG. 6B shows a magnified view of a region C (demarcated by a circle in FIG. 6A) of the load transfer device 140 of FIG. 6A. The load transfer device 140 illustrated in FIG. 6A has a different shape and configuration as compared to the load transfer device of FIG. 5.

In the illustrated embodiment of FIGS. 6A and 6B, each micropillar 145 extends substantially along a micropillar axis 149 and has a height 145H substantially along the micropillar axis 149. The height 145H may be selected based on desired application attributes. In some embodiments, each micropillar 145 has the height 145H of less than 10 millimeters (mm). In some embodiments, the height 145H may be less than 9 mm, less than 8 mm, less than 7 mm, less than 6 mm, less than 5 mm, less than 4 mm, less than 3 mm, less than 2 mm, or less than 1 mm. The height 145H of the plurality of micropillars 145 may be typically less than 10 mm. A smaller value of the height 145H may increase a stiffness of the plurality of micropillars 145, while a greater value of the height 145H may decrease the stiffness of the plurality of micropillars 145. The height 145H may be varied based on application requirements, for example, some of the plurality of micropillars 145 may have a greater value of the height 145H where a lower stiffness is desired and some other of the plurality of micropillars 145 may have a smaller value of the height 145H where a greater stiffness is desired. This may allow designing the load transfer device 140 to be suitable for a non-linear airfoil deflection due to varying loads experienced by the airfoil 130 (shown in FIG. 4). Variations in the height 145H of the plurality micropillars 145 will be further described below.

In the illustrated embodiment of FIGS. 6A and 6B, each micropillar 145 includes an elongate body 146 coupled to the support member 142 and extending towards the airfoil 130 (shown in FIG. 4). The elongate body 146 has a height 146H substantially along the micropillar axis 149. Moreover, in the illustrated embodiment of FIGS. 6A and 6B, each micropillar 145 includes a head 148 disposed on the elongate body 146 distal to the support member 142 and engaging the outer surface 135 of the airfoil 130 (shown in FIG. 4). The head 148 has a height 148H substantially along the micropillar axis 149. The height 148H of the head 148 may be less than the height 146H of the elongate body 146.

In some embodiments, the height 148H of the head 148 may be less than 30%, less than 40%, less than 50%, less than 60%, or less than 70% of the height 146H of the elongate body 146. In some embodiments, the height 148H of the head 148 may be about 1 mm.

In some embodiments, a cross-sectional area of the head 148 is greater than a cross-sectional area of the elongate body 146. In the illustrated embodiment of FIGS. 6A and 6B, each of the elongate body 146 and the head 148 has a substantially rectangular cross-sectional area, and the cross-sectional area of the head 148 is greater than the cross-sectional area of the elongate body 146. In some embodiments, the cross-sectional area of the elongate body 146 may be less than 40%, less than 50%, less than 60%, less than 65%, or less than 70% of the cross-sectional area of the head 148. In some embodiments, the cross-sectional area of the elongate body 146 may be about 64% of the cross-sectional area of the head 148.

The elongate body 146 has a cross-sectional length 146L and a cross-sectional breadth 146B. In some embodiments, the cross-sectional length 146L of the elongate body 146 may be substantially equal to the cross-sectional breadth 146B of the elongate body 146. In some embodiments, the cross-sectional length 146L of the elongate body 146 may be different from the cross-sectional breadth 146B of the elongate body 146.

In some embodiments, the elongate body 146 has the cross-sectional length 146L of less than or equal to 0.8 mm and the cross-sectional breadth 146B of less than or equal to 0.8 mm. This may allow the elongate body 146 of the plurality of micropillars 145 to appropriately elastically deform over a wide range of operating conditions of the gas turbine engine 10 (shown in FIG. 1).

The head 148 has a cross-sectional length 148L and a cross-sectional breadth 148B. In some embodiments, the cross-sectional length 148L of the head 148 may be substantially equal to the cross-sectional breadth 148B of the head 148. In some embodiments, the cross-sectional length 148L of the head 148 may be different from the cross-sectional breadth 148B of the head 148. In some embodiments, the head 148 has the cross-sectional length 148L of less than or equal to 3 mm and the cross-sectional breadth 148B of less than or equal to 3 mm.

In some examples, some of the plurality of micropillars 145 may be designed to have a different size and shape from others of the plurality of micropillars 145. For purposes of the present disclosure, a variation in dimensions (e.g., length, breadth, height) due to manufacturing tolerances or manufacturing defects is considered to be less than or equal to 5%, and a variation in dimensions due to intentional design is considered to be greater than or equal to 10%.

Figure 6C:
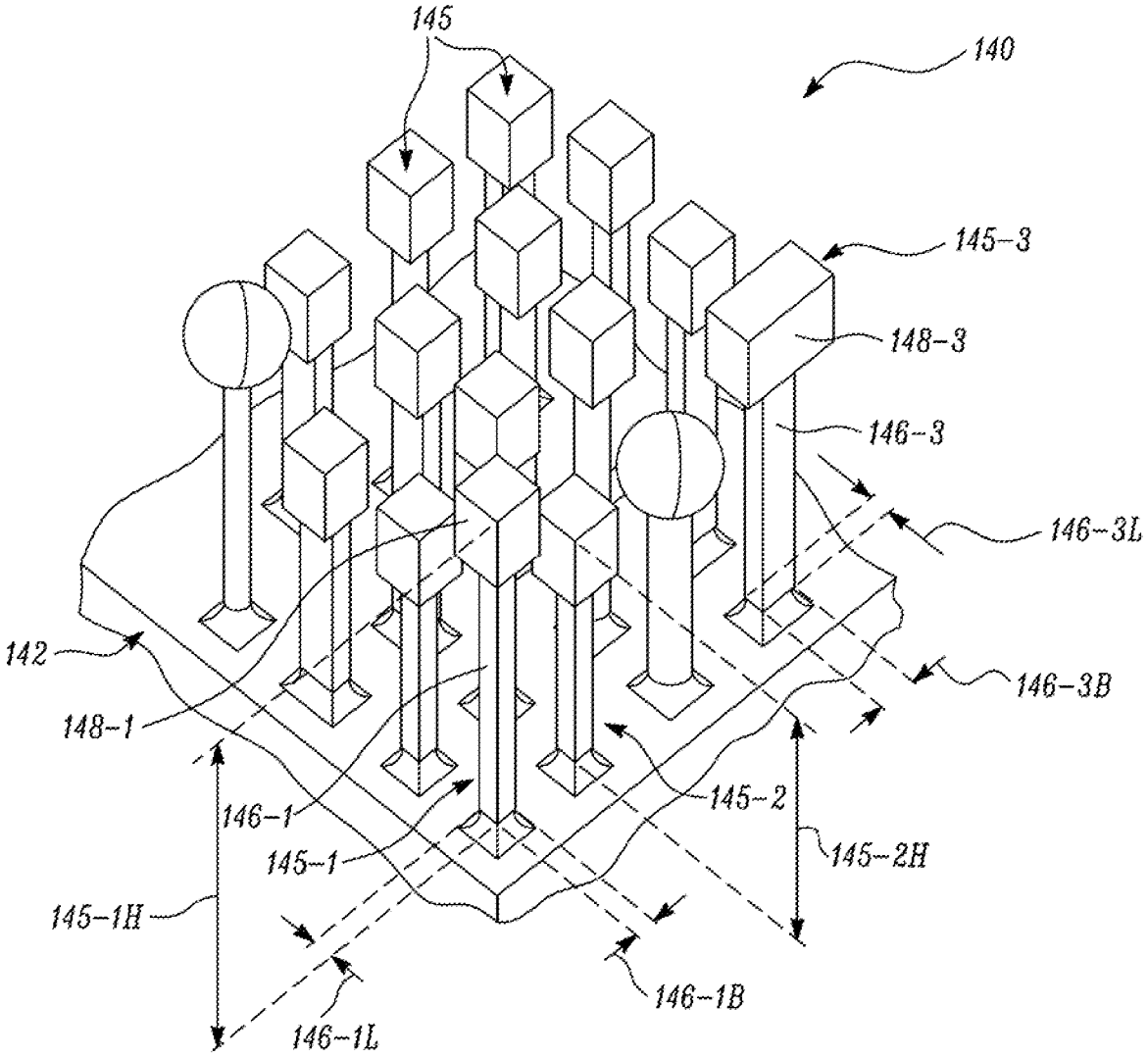
FIG. 6C is a schematic top perspective view of a portion of a load transfer device according to another embodiment of the present disclosure.

FIG. 6C shows a schematic top perspective view of a portion of the load transfer device 140 according to another embodiment of the present disclosure. The load transfer device 140 of FIG. 6C has a different configuration of the plurality of micropillars 145 as compared to the load transfer device 140 of FIG. 6A. As shown in FIG. 6C, the plurality of micropillars 145 may be irregularly spaced apart from each other and have different cross-sectional shapes.

In the illustrated embodiment of FIG. 6C, the plurality of micropillars 145 includes a first micropillar 145-1, a second micropillar 145-2, and a third micropillar 145-3.

The first micropillar 145-1 includes an elongate body 146-1 and a head 148-1 disposed on the elongate body 146-1. The elongate body 146-1 includes a cross-sectional length 146-1L and a cross-sectional breadth 146-1B. Further, the first micropillar 145-1 has a height 145-1H. The second micropillar 145-2 has a height 145-2H. The third micropillar 145-3 includes an elongate body 146-3 and a head 148-3 disposed on the elongate body 146-3. The elongate body 146-3 includes a cross-sectional length 146-3L and a cross-sectional breadth 146-3B.

In some embodiments, at least some of the plurality of micropillars 145 are designed to have non-uniform heights, such that a difference between the heights of the at least some of the plurality of micropillars is greater than or equal to 10%. For example, in the illustrated embodiment of FIG. 6C, the first micropillar 145-1 is designed to have a different height than the second micropillar 145-2. Specifically, the height 145-1H of the first micropillar 145-1 is designed to be greater than 10% of the height 145-2H of the second micropillar 145-2.

Further, in some embodiments, at least some of the plurality of micropillars 145 are designed to have different cross-sectional dimensions, such that a difference between cross-sectional areas of the at least some of the plurality of micropillars is greater than or equal to 10%. For example, in the illustrated embodiment of FIG. 6C, the first micropillar 145-1 is designed to have different cross-sectional dimensions than the third micropillar 145-3. Specifically, the cross-sectional length 146-1L and the cross-sectional breadth 146-1B of the elongate body 146-1 of the first micropillar 145-1 are different than the cross-sectional length 146-3L and the cross-sectional breadth 146-3B, respectively, of the elongate body 146-3 of the third micropillar 145-3, such that a cross-sectional area of the elongate body 146-3 of the third micropillar 145-3 is designed to be greater than 10% of a cross-sectional area of the elongate body 146-1 of the first micropillar 145-1.

In some embodiments, at least some of the plurality of micropillars 145 are designed to have non-uniform stiffnesses, such that a difference between the stiffnesses of the at least some of the plurality of micropillars is greater than or equal to 10%. This may allow designing the load transfer device 140 to be suitable for a non-linear airfoil deflection due to varying loads experienced by the airfoil 130 (shown in FIG. 4).

Referring to FIGS. 4 to 6C, the plurality of micropillars 145 may be perpendicular to the support member 142, (i.e., 90 degrees with respect to the support member 142), or inclined obliquely to the support member 142 (e.g., from about 35 degrees to about 55 degrees with respect to the support member 142). In some examples, some of the plurality of micropillars 145 may be perpendicular and some of the plurality of micropillars 145 may be inclined obliquely to the support member 142.

It may be noted that the plurality of micropillars 145 may have any suitable shape and dimensions, based on desired application requirements. Specifically, size and geometry of the plurality of micropillars 145 may be varied to tailor compliance across the outer surface 135 of the airfoil 130. For example, the elongate body 146 may be cylindrical and have a circular cross-section. In some examples, the elongate body 146 may have a non-uniform cross-section along the micropillar axis 149. In another example, the head 148 may have a hemispherical shape, a diamond shape, etc. Shape and dimensions of the plurality of micropillars 145 may be selected, for example, to improve wear characteristics. Moreover, by selecting suitable shape and dimensions of the plurality of micropillars 145, it may be possible to ensure that adjacent micropillars 145 do not contact or hit each other during deformation. For example, adjacent micropillars 145 from the plurality of micropillars 145 may be disposed spaced apart from each other and define a gap 145G therebetween. The gap 145G may be substantially perpendicular to the micropillar axis 149. In another example, the plurality of micropillars 145 may be designed to deform substantially along the micropillar axis 149 to prevent contact therebetween.

In some examples, the plurality of micropillars 145 may have a negative poisson ratio. This may facilitate tailoring the plurality of micropillars 145 to deflect when loaded by thermal gradients (as the gas turbine engine 10 of FIG. 1 warms up) and pressure loading (when the gas turbine engine 10 of FIG. 1 is hot and increasing in speed), such that the plurality of micropillars 145 does not lose contact with the airfoil 130 and/or the plurality of micropillars 145 does not experience undesirably large bending stresses.

As a result of freedom in designing the plurality of micropillars 145, deflection and stresses induced in the airfoil 130 may be optimized as the gas turbine engine 10 (shown in FIG. 1) heats up and the difference in coefficient of thermal expansion distorts the "as-built" contact area. This may minimize strain accumulation in the airfoil 130, thereby minimizing damage to the airfoil 130.

The plurality of micropillars 145 may be made from resin materials, polymeric materials, or suitable metallic materials, such as titanium, steel, nickel, cobalt, and alloys thereof Further, the plurality of micropillars 145 may be fabricated using any suitable manufacturing method. For example, the plurality of micropillars 145 may be fabricated using injection molding, laser cutting, etc. The plurality of micropillars 145 may be preferably fabricated using additive manufacturing (e.g., high resolution additive manufacturing). Additive manufacturing, particularly high resolution additive manufacturing, may allow a wide range of materials to be selected for fabricating the plurality of micropillars 145. Moreover, additive manufacturing may prevent a need for further post-processing and/or assembly processes.

In the illustrated embodiment of FIG. 6A, the support member 142 includes a base plate 143 and an insert 144 removably attached to the base plate 143. Moreover, the plurality of micropillars 145 is fixedly attached to and extends from the insert 144. The base plate 143 may be fixedly attached to the at least one of the inner carrier 110 and the outer carrier 120 (shown in FIG. 4). Advantageously, the insert 144 may be easily replaced if the plurality of micropillars 145 needs replacement. For example, the insert 144 may be replaced if some of the plurality of micropillars 145 inelastically deform. The insert 144 may be removably attached to the base plate 143 by any suitable methods, such as mechanical fasteners, tongue and groove joint, and so forth. Further, in the illustrated embodiment of FIG. 6A, the base plate 143 includes multiple apertures 147 that receive mechanical fasteners (e.g., bolts, screws, rivets, etc.) for coupling the base plate 143 to the at least one of the inner carrier 110 and the outer carrier 120. In some other embodiments, the base plate 143 may be coupled to the at least one of the inner carrier 110 and the outer carrier 120 by any other suitable methods, such as welding, tongue and groove joint, and so forth.

Figure 7A:
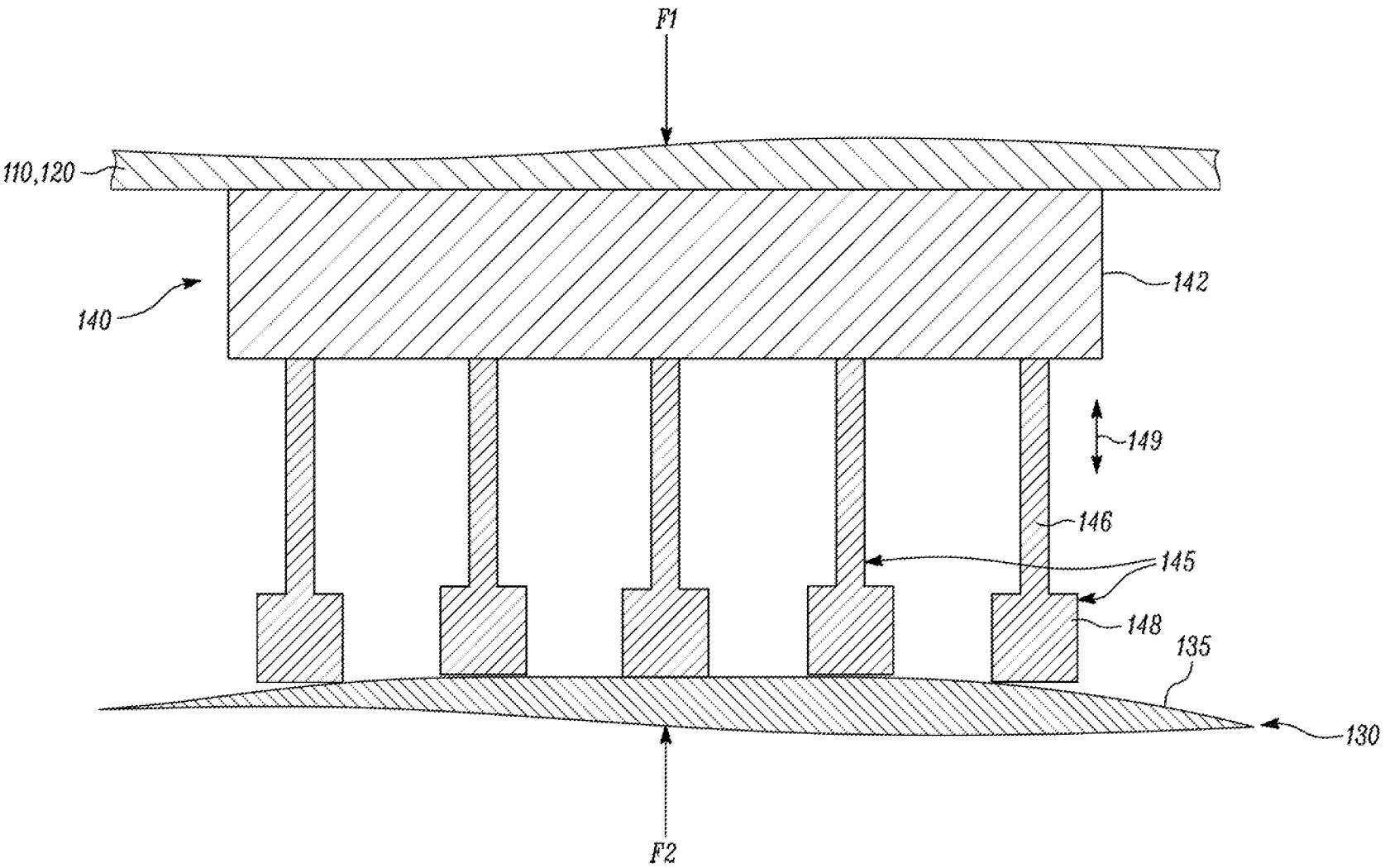
FIGS. 7A and 7B are schematic cross-sectional views depicting exemplary engagement and deformation of a plurality of micropillars of the load transfer device.
Figure 7B:
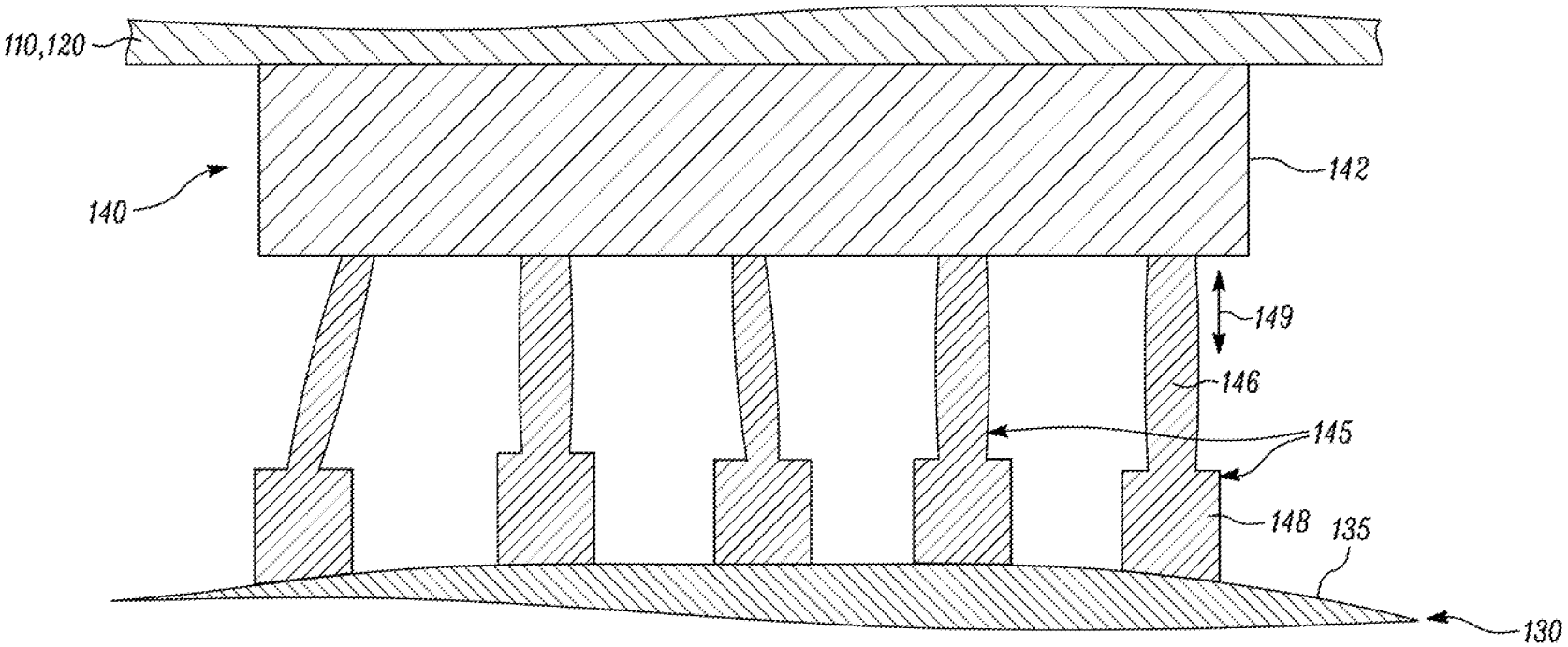

FIGS. 7A and 7B schematically show exemplary engagement of the plurality of micropillars 145 with the outer surface 135 and deformation of the plurality of micropillars 145. The inner carrier 110/outer carrier 120, the support member 142, the plurality of micropillars 145, and the airfoil 130 are cross-hatched in FIGS. 7A and 7B for clarity purposes.

A first load F1 may be applied by the inner carrier 110 and/or the outer carrier 120 on the airfoil 130. Specifically, the first load F1 may be an expansion load applied by the inner carrier 110 and/or the outer carrier 120 on the outer surface 135 of the airfoil 130. A second load F2 may be applied by the airfoil 130 on the inner carrier 110 and/or the outer carrier 120. The second load F2 may be an aerodynamic load experienced by the airfoil 130.

Upon application of the first load F1 and/or the second load F2, the plurality of micropillars 145 may elastically deform (see FIG. 7B). For example, the head 148 and/or the elongate body 146 of the plurality of micropillars 145 may elastically deform. Preferably, the plurality of micropillars 145 may elastically deform in such a manner that adjacent micropillars 145 from the plurality of micropillars 145 do not contact each other. In one example, the plurality of micropillars 145 may deform substantially along the micropillar axis 149.

Therefore, the load transfer device 140 may transmit force and motion between the airfoil 130 and the at least one of the inner carrier 110 and the outer carrier 120. The plurality of micropillars 145 may reduce induced stresses in the airfoil 130 due to the first load F1 and/or the second load F2. Moreover, the plurality of micropillars 145 may improve load sharing and stress distribution across the outer surface 135 of the airfoil 130. As a result, the operational life expectancy and lifespan of the airfoil 130 may be prolonged.

Figure 8:
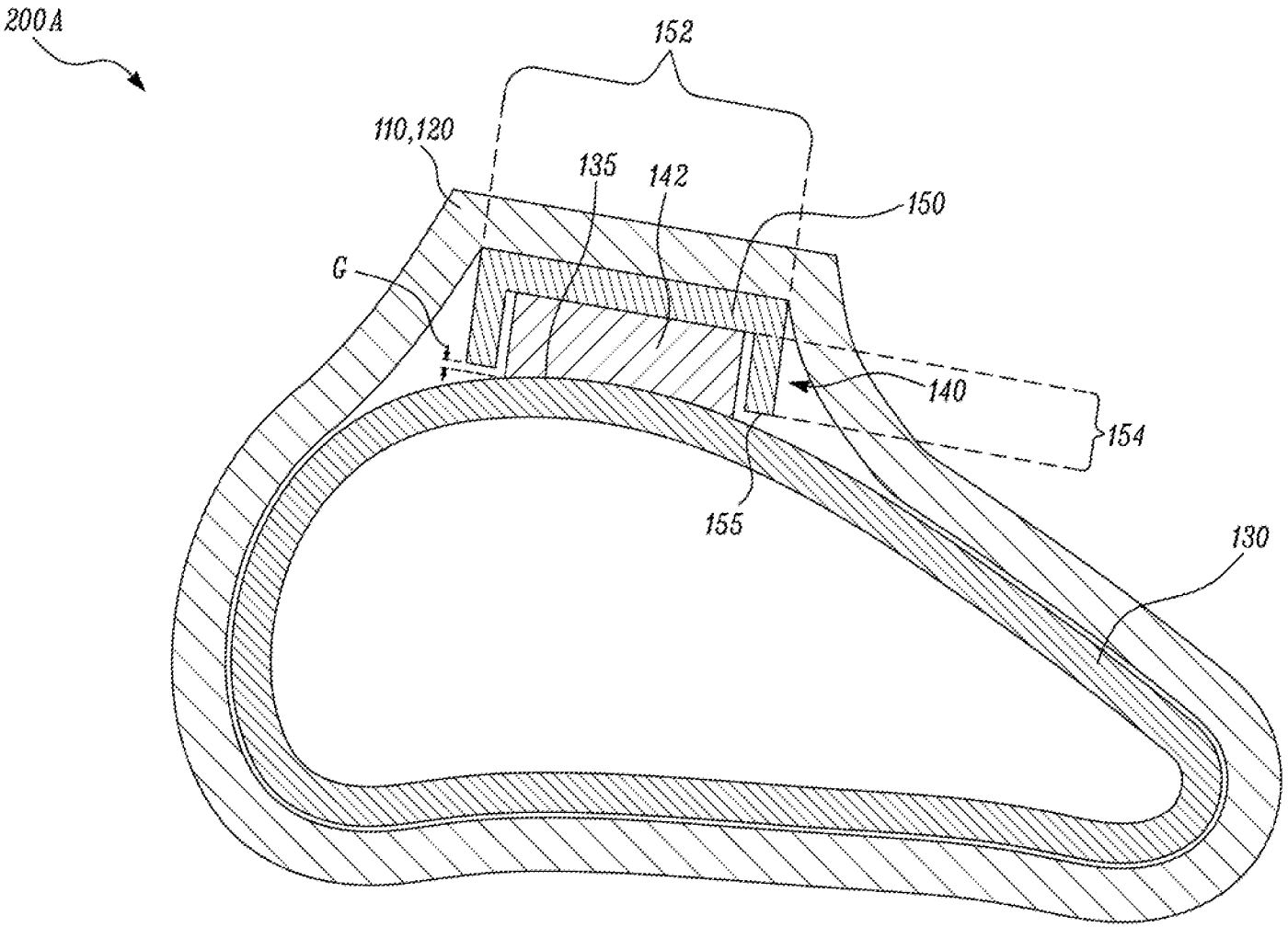
FIG. 8 is a schematic cross-sectional view of a portion of the stator vane assembly according to another embodiment of the present disclosure.

FIG. 8 shows a schematic diagram of a stator vane assembly 200A according to another embodiment of the present disclosure. The stator vane assembly 200A is similar to the stator vane assembly 100 of FIG. 4, with like elements designated by like reference numerals. However, in the illustrated embodiment of FIG. 8, the load transfer device 140 further includes a datum member 150 at least partially enclosing the support member 142 and the plurality of micropillars 145 (shown in FIG. 9). The plurality of micropillars 145 is not shown in FIG. 8 for clarity purposes. In some embodiments, the datum member 150 is integral with or fixedly attached to the support member 142. In some examples, the datum member 150 may be fixedly attached to the support member 142 by various methods, such as welding, mechanical fasteners, tongue and groove joint, and so forth.

Figure 9:
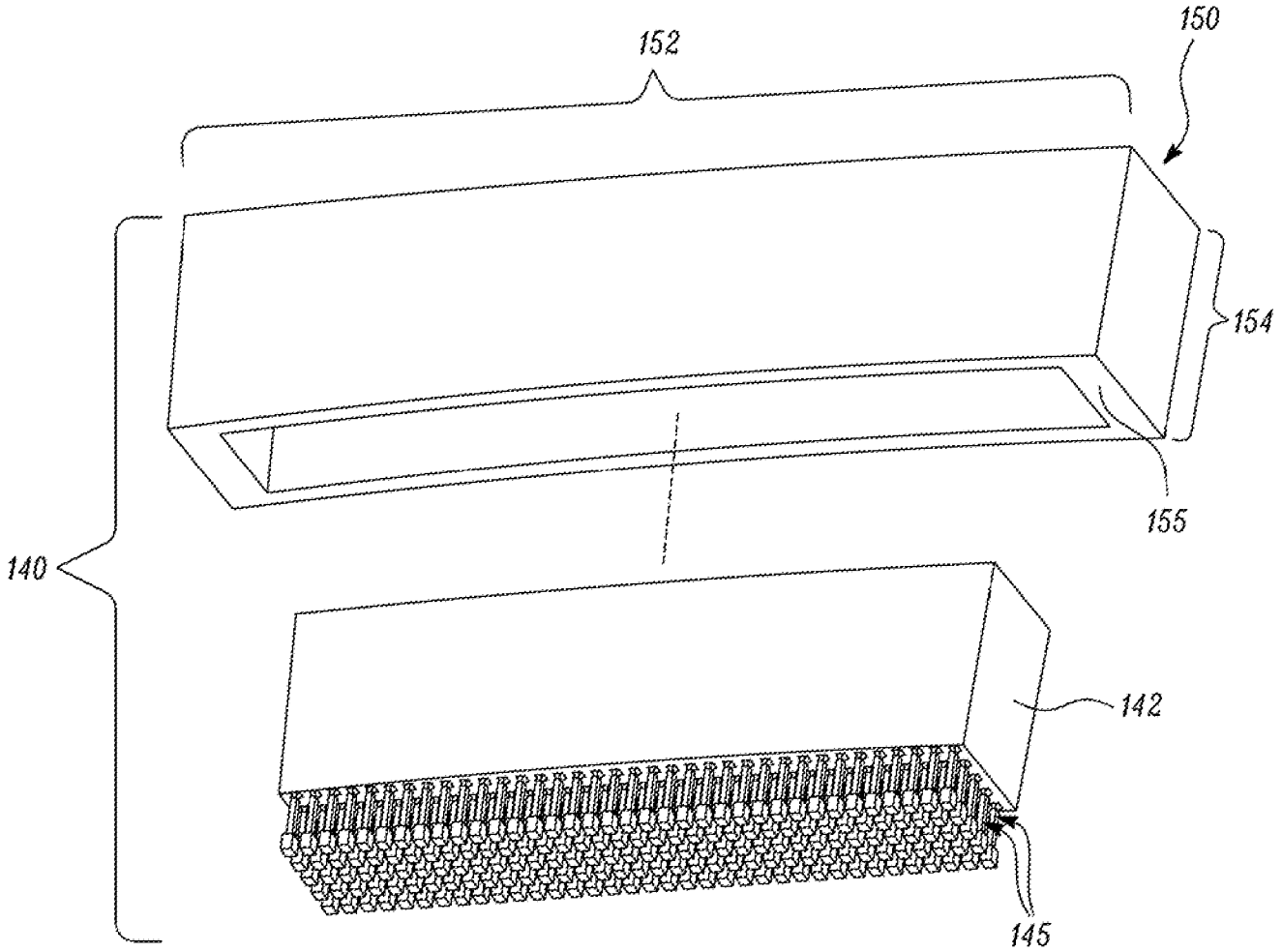
FIG. 9 is a schematic exploded bottom perspective view of a load transfer device of the stator vane assembly of FIG. 8 according to an embodiment of the present disclosure.

Referring to FIGS. 8 and 9, the datum member 150 includes a first portion 152 disposed at least partially between the support member 142 and the at least one of the inner carrier 110 and the outer carrier 120. The first portion 152 engages the support member 142 and the at least one of the inner carrier 110 and the outer carrier 120. In some embodiments, the first portion 152 is fixedly attached to the at least one of the inner carrier 110 and the outer carrier 120. In some examples, the first portion 152 of the datum member 150 may be fixedly attached to the at least one of the inner carrier 110 and the outer carrier 120 by various methods, such as welding, mechanical fasteners, tongue and groove joint, and so forth.

The datum member 150 further includes a second portion 154 extending from the first portion 152 and spaced apart from the airfoil 130. The second portion 154 may include an engaging surface 155 opposite to the first portion 152 and proximal to the airfoil 130. The engaging surface 155 of the second portion 154 may be spaced apart from the outer surface 135 of the airfoil 130 by a gap G. The gap G may be defined as a minimum distance between the engaging surface 155 and the outer surface 135. In some examples, the datum member 150 may define a substantially cuboidal volume for at least partially enclosing the support member 142 and the plurality of micropillars 145. Further, the first portion 152 may have a substantially rectangular shape and the second portion 154 may include four adjoining walls (not shown) extending from respective edges of the first portion 152. Therefore, the first portion 152 and the second portion 154 may together define the substantially cuboidal volume therebetween.

The datum member 150 may engage the airfoil 130 under excessive loads. Specifically, the second portion 154 of the datum member 150 may engage the airfoil 130 under excessive loads. More specifically, the engaging surface 155 of the second portion 154 may engage the outer surface 135 of the airfoil 130 under excessive loads. The datum member 150 may be configured to tolerate a full magnitude of loading in case of failure of at least some of the plurality of micropillars 145 (e.g., in case at least some of the plurality of micropillars 145 plastically deform due to excessive loads). The plurality of micropillars 145 may effectively off-load the datum member 150 by increasing a contact area and reducing bearing stresses when the datum member 150 is spaced apart from the outer surface 135 of the airfoil 130 (e.g., during normal operating conditions with normal loads). Further, the datum member 150 may prevent deflection of the plurality of micropillars 145 beyond a predetermined magnitude, thereby preventing or significantly reducing inelastic deformation thereof. As a result, the datum member 150 may protect the plurality of micropillars 145 against plastic deformation/failure due to excessive loads. Moreover, the datum member 150 may reduce or prevent ingress of debris into gaps between the plurality of micropillars 145, thereby preventing deterioration of a performance of the load transfer device 140 due to the debris.

Figure 10:
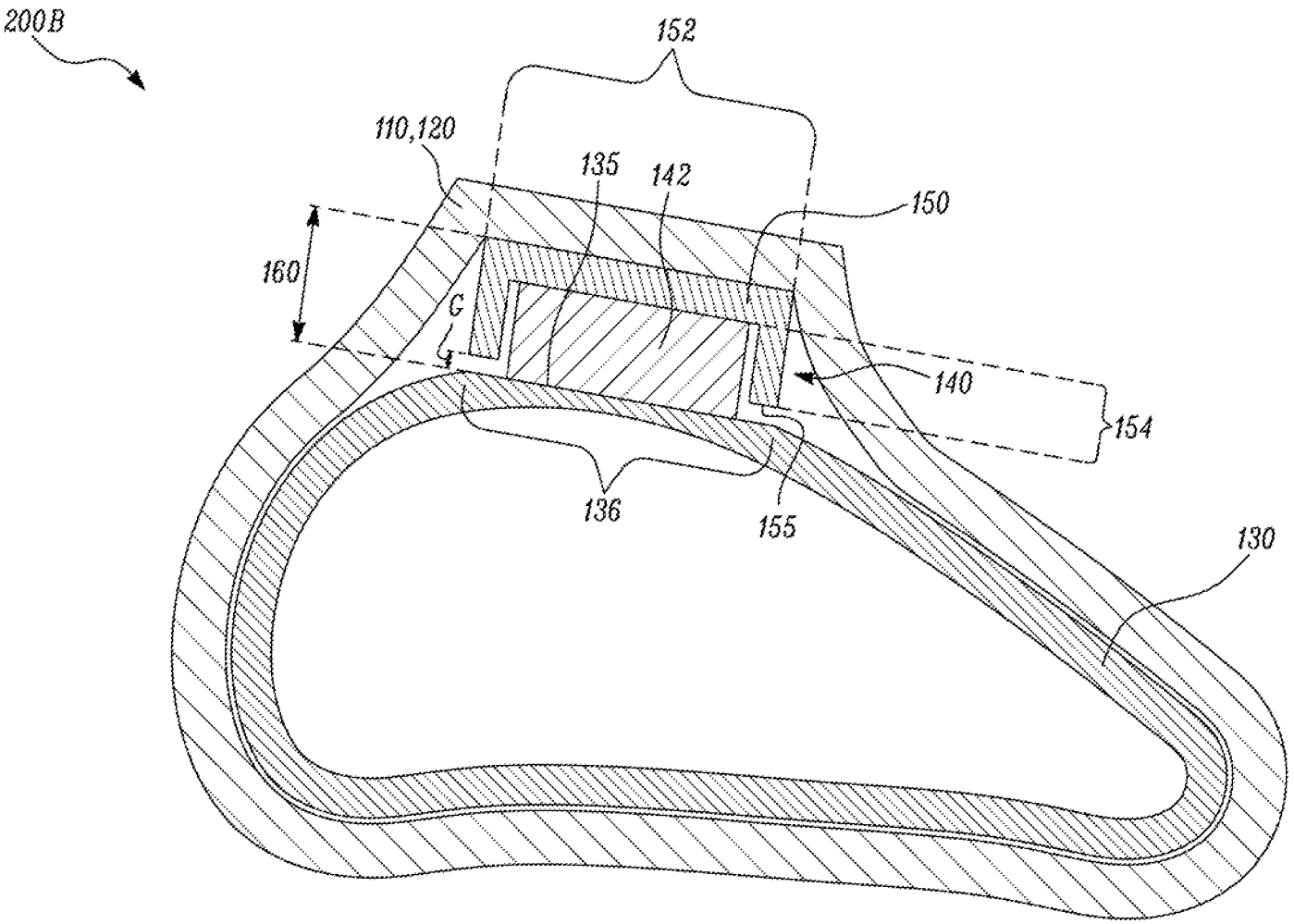
FIG. 10 is a schematic cross-sectional view of a portion of the stator vane assembly according to another embodiment of the present disclosure.

FIG. 10 shows a schematic diagram of a stator vane assembly 200B according to another embodiment of the present disclosure. The stator vane assembly 200B is similar to the stator vane assembly 200A of FIG. 8, with like elements designated by like reference numerals. However, the stator vane assembly 200B has a different configuration of the airfoil 130.

Figure 11A:
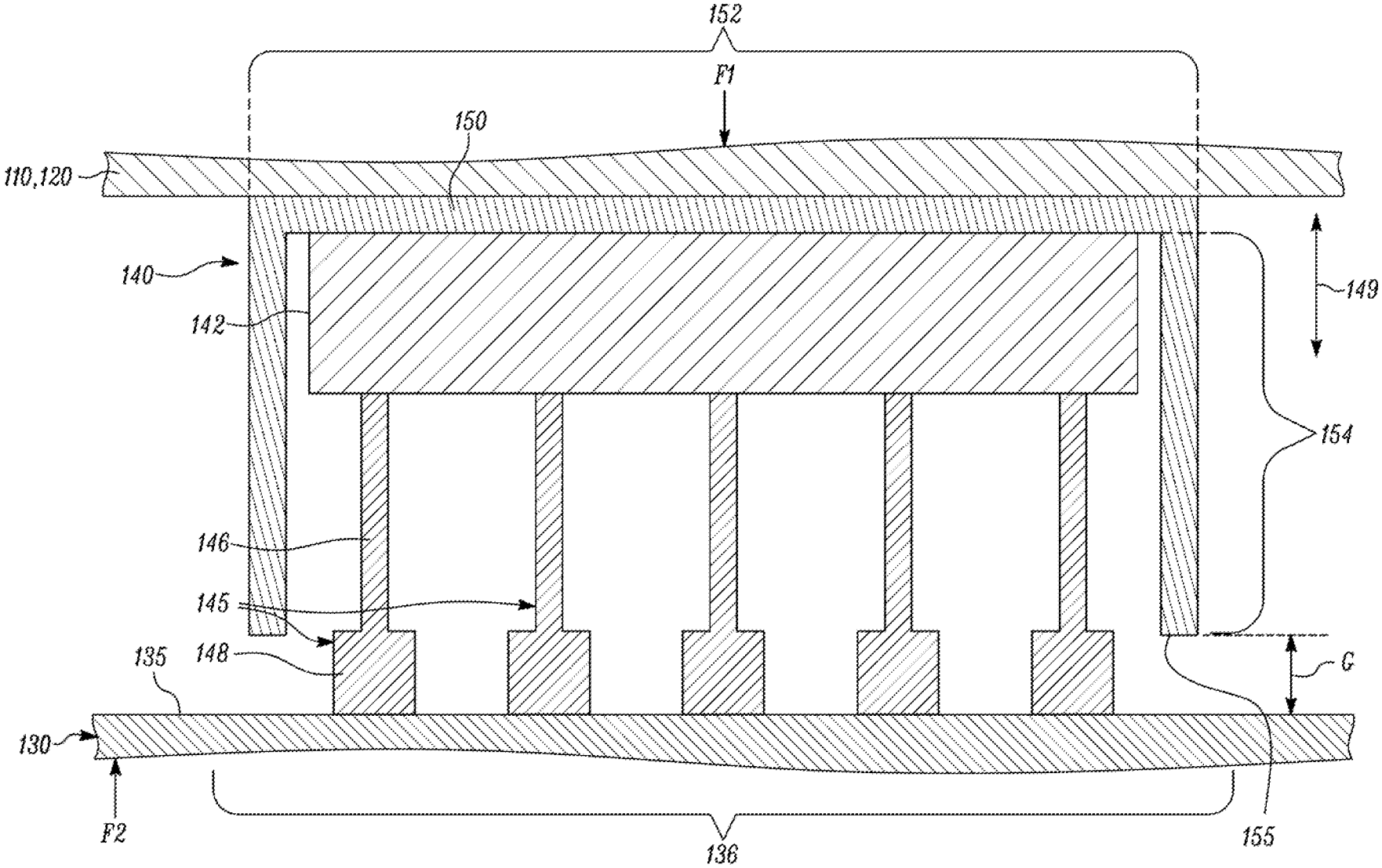
FIGS. 11A and 11B are schematic cross-sectional views depicting exemplary engagement and deformation of a plurality of micropillars and a datum member of the load transfer device of FIG. 9.
Figure 11B:
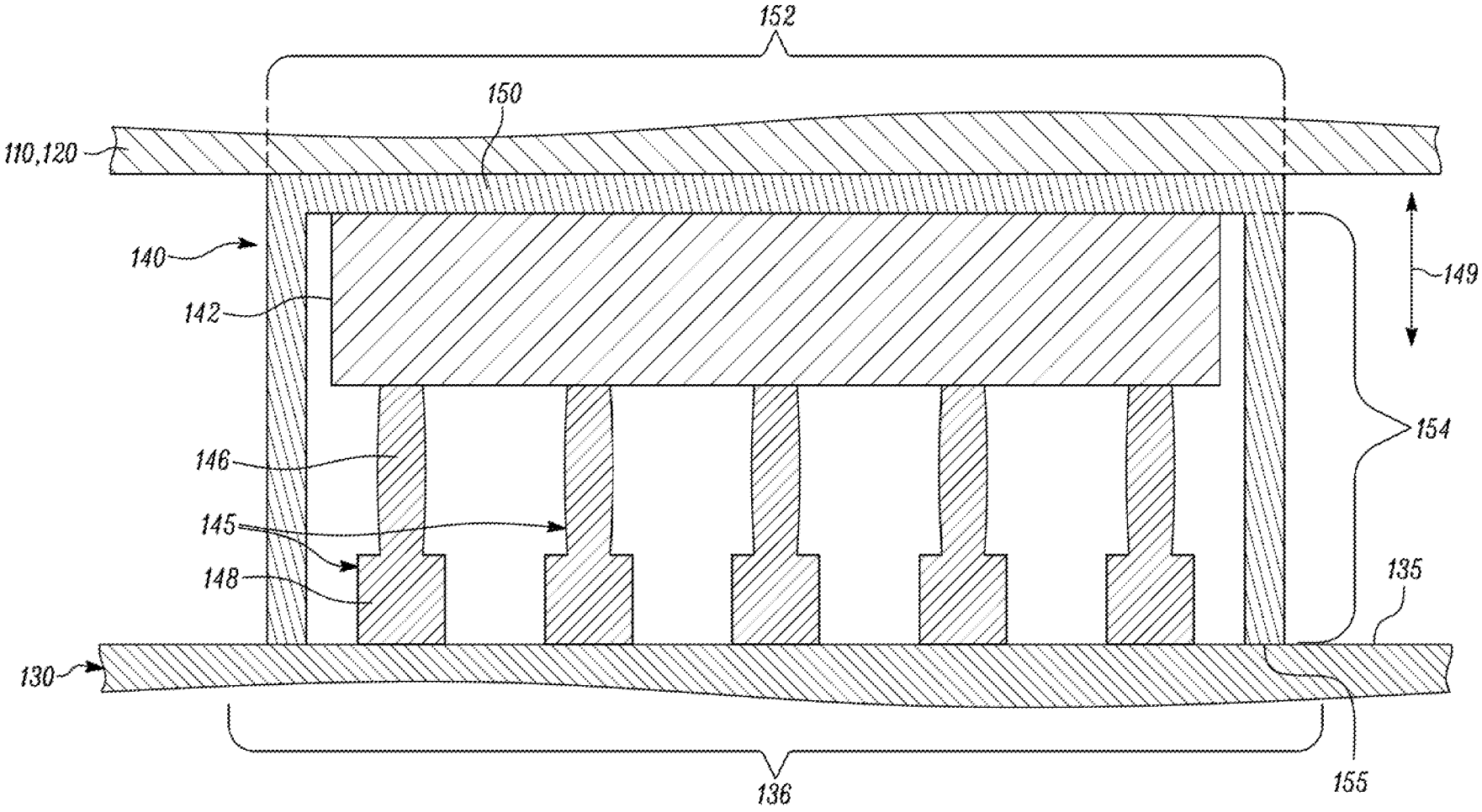

Specifically, in the illustrated embodiment of FIG. 10, the outer surface 135 of the airfoil 130 includes a planar surface portion 136 engaging with the plurality of micropillars 145 (shown in FIGS. 11A and 11B). Further, in the illustrated embodiment of FIG. 10, the second portion 154 of the datum member 150 is spaced apart from the planar surface portion 136. Specifically, the engaging surface 155 of the second portion 154 is spaced apart from the planar surface portion 136 by the gap G. The planar surface portion 136 may be formed by machining the outer surface 135 of the airfoil 130. The planar surface portion 136 may reduce a tolerance stack-up and/or a location uncertainty of the load transfer device 140. The planar surface portion 136 may further allow alignment of the load transfer device 140 relative to the airfoil 130.

FIGS. 11A and 11B schematically show exemplary engagement of the plurality of micropillars 145 with the planar surface portion 136 of the outer surface 135, and deformation thereof. FIGS. 11A and 11B further show functioning of the datum member 150 upon deformation of the plurality of micropillars 145. The inner carrier 110/outer carrier 120, the support member 142, the plurality of micropillars 145, the datum member 150, and the airfoil 130 are cross-hatched in FIGS. 11A and 11B for clarity purposes.

Upon application of the first load F1 and/or the second load F2, the plurality of micropillars 145 may elastically deform (see FIG. 11B). In the illustrated example of FIGS. 11A and 11B, each of the plurality of micropillars 145 deforms substantially along the micropillar axis 149. Further, the second portion 154 of the datum member 150 may engage the airfoil 130 (specifically, the engaging surface 155 of the second portion 154 may engage the outer surface 135 of the airfoil 130) upon application of the first load F1 and/or the second load F2 (in case the first load F1 and/or the second load F2 are greater than a predetermined value). Therefore, the plurality of micropillars 145 and the datum member 150 may transmit force and motion between the airfoil 130 and the at least one of the inner carrier 110 and the outer carrier 120.

Figure 12:
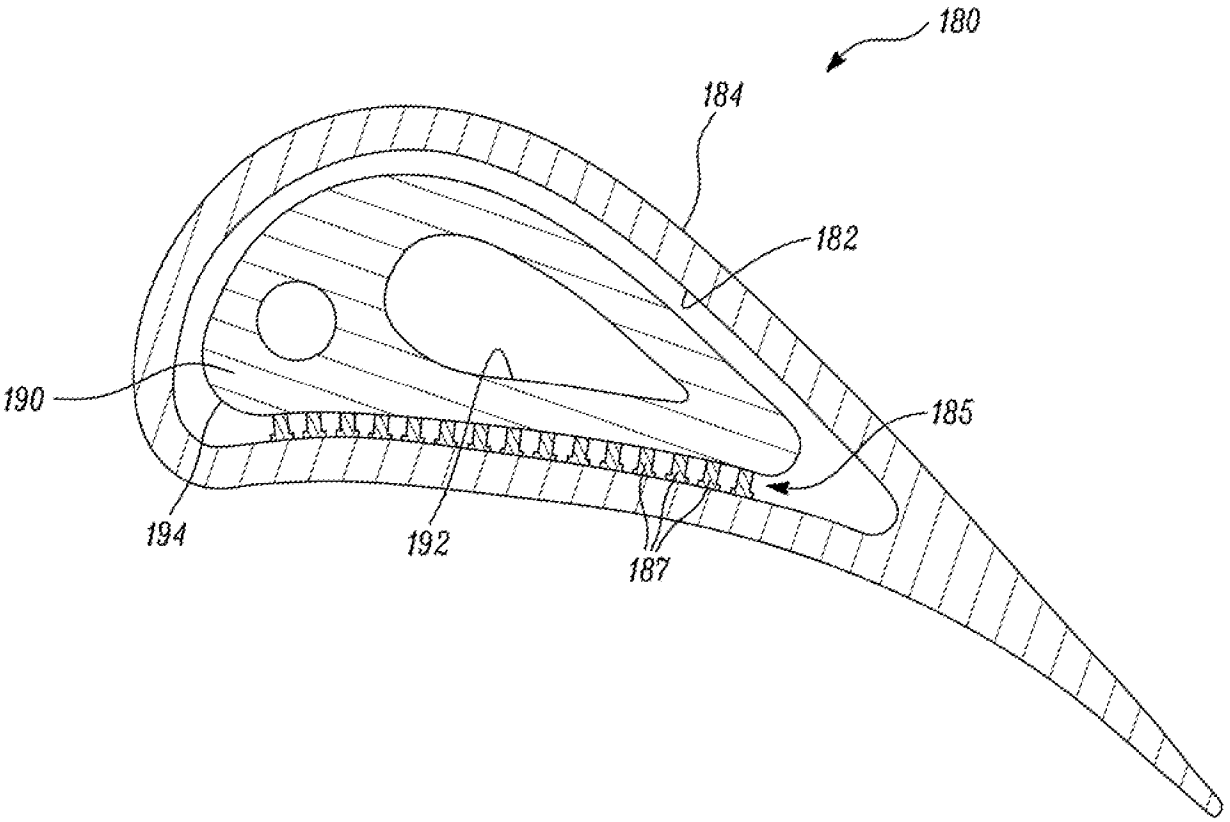
FIG. 12 is a schematic cross-sectional view of an airfoil according to an embodiment of the present disclosure.

FIG. 12 shows a schematic cross-sectional view of a ceramic-containing airfoil 180 (interchangeably referred to as "the airfoil 180") according to an embodiment of the present disclosure. The airfoil 180 may be used in the stator vane assembly 100 (shown in FIG. 2). In other words, the gas turbine engine 10 (shown in FIG. 1) may include the airfoil 180. The gas turbine engine 10 may further include a spar 190 disposed inside the airfoil 180. The gas turbine engine 10 may further include a load transfer device 185 disposed between the spar 190 and the airfoil 180.

The airfoil 180 includes an inner surface 182 and an outer surface 184. The spar 190 includes an inner surface 192 and an outer surface 194. The airfoil 180 may at least partially surround the spar 190. Specifically, the inner surface 182 of the airfoil 180 may at least partially surround the outer surface 194 of the spar 190.

The load transfer device 185 includes a plurality of micropillars 187. The plurality of micropillars 187 is similar to the plurality of micropillars 145 (shown in FIGS. 5, 6A, and 6B) described above. That is, the plurality of micropillars 187 may have an equivalent structure and functionality as that of the plurality of micropillars 145. Specifically, each micropillar 187 is deformable and engages the airfoil 180.

The plurality of micropillars 187 is coupled to the spar 190 and extends towards the airfoil 180. The plurality of micropillars 187 may be directly or indirectly coupled to the spar 190. Examples of direct coupling may include the plurality of micropillars 187 being integrally manufactured with the spar 190 (e.g., by additive manufacturing) or directly attached to the spar 190. An example of indirect coupling may include the plurality of micropillars 187 being coupled to a support member (e.g., similar to the support member 142 shown in FIGS. 5, 6A and 6B), and the support member being attached to the spar 190.

In the illustrated embodiment of FIG. 12, the plurality of micropillars 187 is directly coupled to the spar 190 and extends towards the airfoil 180. Specifically, in the illustrated embodiment of FIG. 12, the plurality of micropillars 187 extends from the outer surface 194 of the spar 190 towards the inner surface 182 of the airfoil 180. In some examples, the plurality of micropillars 187 engages the inner surface 182 of the airfoil 180.

The spar 190 may be interchangeably referred to as the first component that includes a metallic material. The metallic material may include a metal or a metal alloy. In some examples, the metallic material includes a material capable of maintaining its strength and shape at high temperatures, such as aluminum, titanium, nickel, cobalt, and the like, and alloys thereof. The airfoil 180 may be interchangeably referred to as the second component that includes a ceramic material. The load transfer device 185 may transfer loads between the spar 190 and the airfoil 180 and reduce induced stresses in the airfoil 180, thereby improving an operational lifespan of the airfoil 180.

Referring back to FIG. 2, the turbine 18 further includes a turbine shroud assembly 300 circumferentially encasing the rotor blade 36 with respect to the rotational axis 20. The turbine shroud assembly 300 may block combustion products from leaking past the rotor blade 36 without pushing the rotor blade 36 to rotate the turbine wheel assembly 26.

Figure 13:
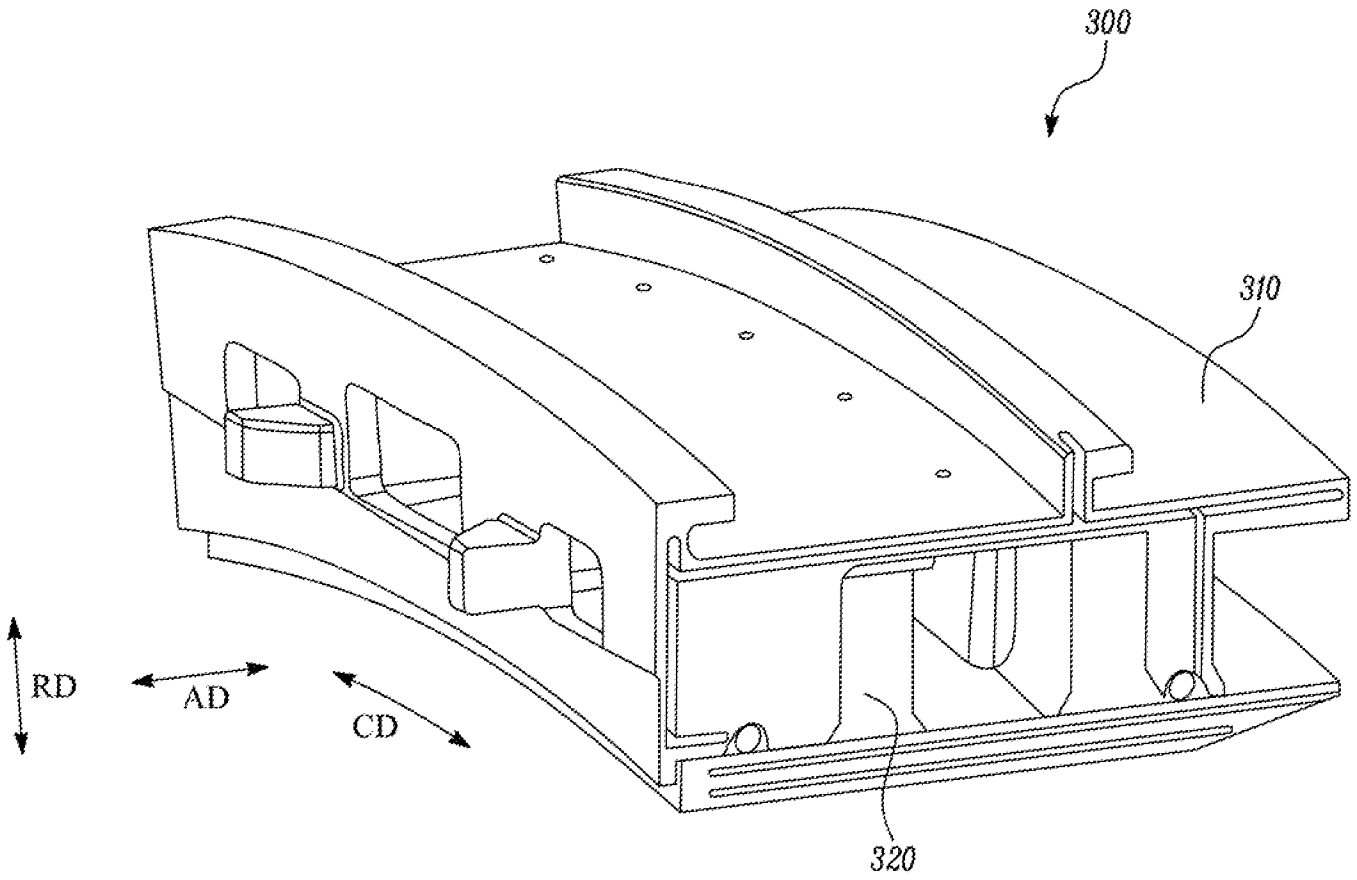
FIG. 13 is a schematic perspective view of a portion of a turbine shroud assembly of the gas turbine engine according to an embodiment of the present disclosure.

FIG. 13 shows a schematic perspective view of a portion of the turbine shroud assembly 300 according to an embodiment of the present disclosure. Specifically, FIG. 13 shows a turbine shroud segment of the turbine shroud assembly 300. A radial direction RD, a circumferential direction CD, and an axial direction AD are also depicted in FIG. 13. The axial direction AD may be substantially aligned with the rotational axis 20, while the radial direction RD and the circumferential direction CD may be defined relative to the rotational axis 20.

Referring to FIGS. 2 and 13, the turbine shroud assembly 300 includes a carrier segment 310 and a ceramic-containing seal segment 320 (interchangeably referred to as "the seal segment 320") coupled to the carrier segment 310. Specifically, the turbine shroud segment of the turbine shroud assembly 300 includes the carrier segment 310 and the ceramic-containing seal segment 320. The seal segment 320 faces the rotor blade 36. A plurality of individual turbine shroud segments (as shown in FIG. 13) of the turbine shroud assembly 300 may be arranged circumferentially adjacent to one another (in the circumferential direction CD) to form an annular ring structure around the rotational axis 20 and around the turbine wheel assembly 26. The rotor blade 36 may engage at its distal end with the seal segment 320 to block combustion products from leaking past the rotor blade 36. Specifically, the rotor blade 36 may brush against the seal segment 320. As a result, the seal segment 320 may experience centrifugal loads from a tip of the rotor blade 36 brushing against it during rotation of the turbine wheel assembly 26.

The carrier segment 310 includes a metallic material, and the seal segment 320 is made of a ceramic material (for example, a CMC material). The carrier segment 310 may be interchangeably referred to as the first component that includes a metallic material, and the seal segment 320 may be interchangeably referred to as the second component that includes a ceramic material. The metallic material of the carrier segment 310 may include a metal or a metal alloy. In some examples, the metallic material of the carrier segment 310 includes aluminum, titanium, nickel, cobalt, and the like, and alloys thereof. In some embodiments, the first component is one of the inner carrier 110, the outer carrier 120, and the carrier segment 310, and the second component is one of the airfoil 130 and the seal segment 320.

Figure 14:
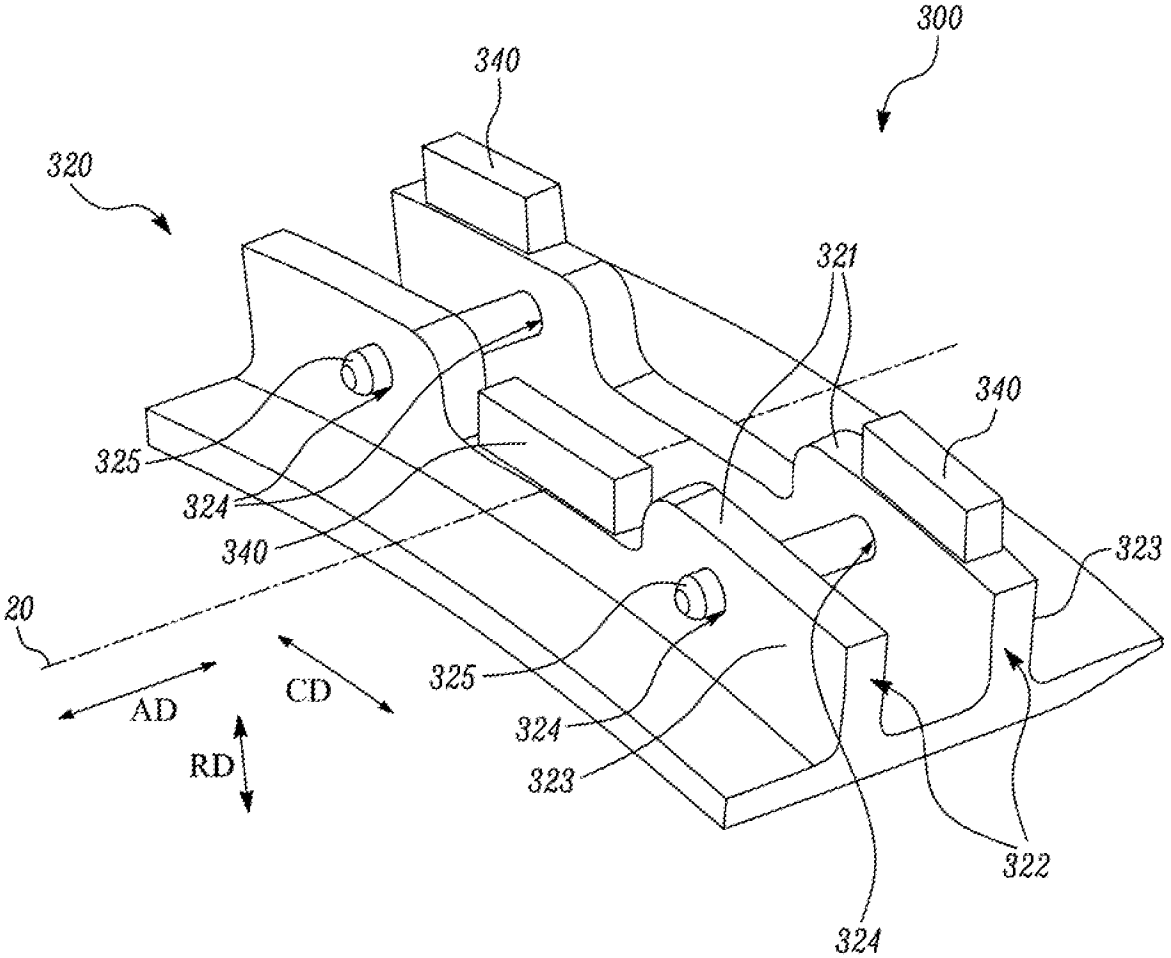
FIG. 14 is a schematic perspective view of the portion of the turbine shroud assembly of FIG. 13 with a carrier segment not shown.
Figure 15:
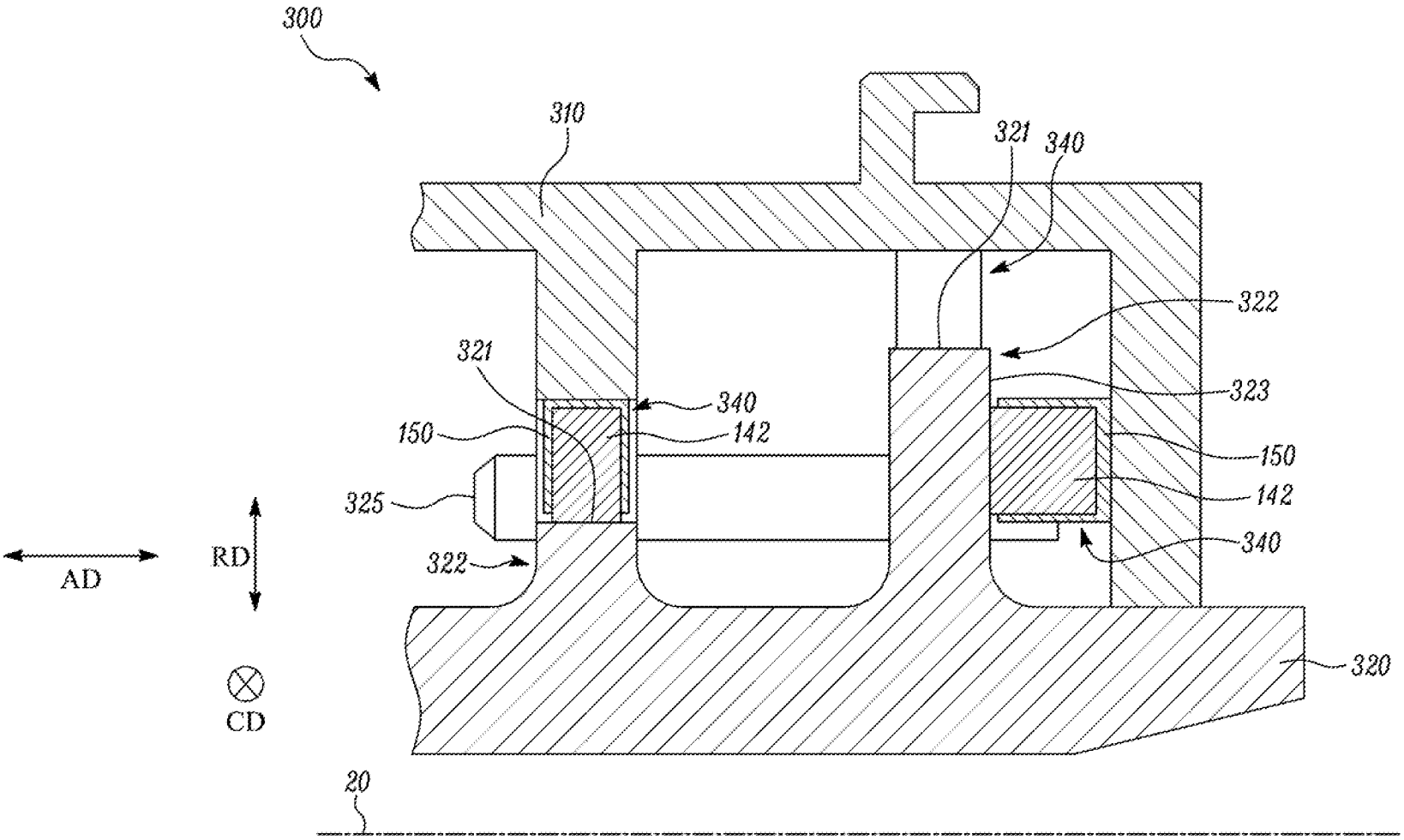
FIG. 15 is a schematic partial cross-sectional view of the portion of the turbine shroud assembly of FIG. 13 according to an embodiment of the present disclosure.

FIG. 14 shows a perspective view of the portion of the turbine shroud assembly 300 with the carrier segment 310 not shown for illustrative purposes. FIG. 15 shows a partial cross-sectional view of the portion of the turbine shroud assembly 300.

Referring to FIGS. 14 and 15, the seal segment 320 includes a flange 322 extending towards the carrier segment 310. In the illustrated embodiment of FIGS. 14 and 15, the seal segment 320 includes two flanges 322 spaced apart from each other along the axial direction AD. The flange 322 includes one or more apertures 324 for at least partially receiving one or more pins 325 that couple the seal segment 320 to the carrier segment 310. The carrier segment 310 may include one or more apertures (not shown) that receive a portion of the respective one or more pins 325 to couple the seal segment 320 to the carrier segment 310. The flange 322 further includes a radially outer surface 321 facing the carrier segment 310. The flange 322 further includes an axial surface 323 extending from the radially outer surface 321 and facing the carrier segment 310.

As discussed above, the carrier segment 310 includes a metallic material, and the seal segment 320 is made of a ceramic material. Consequently, there may be a significant coefficient of thermal expansion mismatch between the carrier segment 310 and the seal segment 320. As a result, the carrier segment 310 may apply expansion loads on the seal segment 320 due to high operating temperatures within the gas turbine engine 10 (shown in FIG. 1). Moreover, as discussed above, the seal segment 320 may experience centrifugal loads from the tip of the rotor blade 36. The loads (e.g., expansion loads, centrifugal loads, etc.) may induce considerable stresses in the seal segment 320 and may significantly reduce an operational life expectancy of the seal segment 320 (as the seal segment 320 is made from strain intolerant ceramic materials).

To mitigate undesirable effects of the loads, the turbine shroud assembly 300 further includes a second load transfer device 340 (interchangeably referred to as "the load transfer device 340") disposed between the carrier segment 310 and the seal segment 320. In other words, the load transfer device 340 is disposed between the first component and the second component.

The second load transfer device 340 is similar to the first load transfer device 140 (shown in FIGS. 5, 6, and 9), with like elements designated by like reference numerals. However, the support member 142 of the second load transfer device 340 is fixedly attached to the carrier segment 310. In some examples, the support member 142 may be fixedly attached to the carrier segment 310 by any suitable method, such as mechanical fasteners, welding, tongue and groove joint, and so forth. Further, the plurality of micropillars 145 of the second load transfer device 340 is coupled to the support member 142 and extends towards the seal segment 320. The plurality of micropillars 145 is not shown in FIGS. 14 and 15 for clarity purposes. Each micropillar 145 of the second load transfer device 340 is deformable and engages the seal segment 320.

In some embodiments, the turbine shroud assembly 300 includes a plurality of the second load transfer devices 340. In the illustrated embodiment of FIG. 14, at least one of the second load transfer device 340 includes the datum member 150. The datum member 150 of the second load transfer device 340 may engage with the seal segment 320 in case of failure of at least some of the plurality of micropillars 145 (e.g., in case at least some of the plurality of micropillars 145 plastically deform due to excessive loads).

In some embodiments, at least one second load transfer device 340 from the plurality of the second load transfer devices 340 is radially disposed (i.e., along the radial direction RD) between the carrier segment 310 and the seal segment 320 with respect to the rotational axis 20. In some embodiments, at least one other second load transfer device 340 from the plurality of the second load transfer devices 340 is axially disposed (i.e., along the axial direction AD) between the carrier segment 310 and the seal segment 320 with respect to the rotational axis 20.

Specifically, in the illustrated embodiment of FIG. 14, the at least one second load transfer device is radially disposed between the radially outer surface 321 and the carrier segment 310 with respect to the rotational axis 20, such that each micropillar 145 (shown in FIGS. 5, 6, and 9) of the at least one second load transfer device 340 engages the radially outer surface 321. Further, the at least one other second load transfer device 340 is axially disposed between the axial surface 323 and the carrier segment 310 with respect to the rotational axis 20, such that each micropillar 145 of the at least one other second load transfer device 340 engages the axial surface 323.

The second load transfer device 340 may reduce induced stresses in the seal segment 320. Moreover, the second load transfer device 340 may improve load sharing and stress distribution across the radially outer surface 321 and the axial surface 323 of the seal segment 320. As a result, the operational life expectancy and lifespan of the seal segment 320 may be prolonged.

Although examples are illustrated and described herein, embodiments are nevertheless not limited to the details shown, since various modifications and structural changes may be made therein by those of ordinary skill within the scope and range of equivalents of the claims.

What is claimed is:

1. A stator vane assembly for a gas turbine engine, the stator vane assembly comprising:
- an inner carrier comprising a metallic material;
- an outer carrier comprising a metallic material;
- a ceramic-containing airfoil that extends from the inner carrier to the outer carrier and is at least partially received by the inner carrier and the outer carrier; and
- a load transfer device disposed between the ceramic-containing airfoil and at least one of the inner carrier and the outer carrier, the load transfer device comprising:
  - a support member fixedly attached to the at least one of the inner carrier and the outer carrier; and
  - a plurality of micropillars coupled to the support member and extending towards the ceramic-containing airfoil, wherein each micropillar is deformable and engages the ceramic-containing airfoil.

2. The stator vane assembly of claim 1, wherein each micropillar comprises:
- an elongate body coupled to the support member and extending towards the ceramic-containing airfoil; and
- a head disposed on the elongate body distal to the support member and engaging an outer surface of the ceramic-containing airfoil;
- wherein a cross-sectional area of the head is greater than a cross-sectional area of the elongate body.

3. The stator vane assembly of claim 2, wherein the elongate body has a cross-sectional length of less than or equal to 0.8 mm and a cross-sectional breadth of less than or equal to 0.8 mm.

4. The stator vane assembly of claim 2, wherein the head has a cross-sectional length of less than or equal to 3 mm and a cross-sectional breadth of less than or equal to 3 mm.

5. The stator vane assembly of claim 1, wherein at least some of the plurality of micropillars are designed to have different cross-sectional dimensions, such that a difference between cross-sectional areas of the at least some of the plurality of micropillars is greater than or equal to 10%.

6. The stator vane assembly of claim 1, wherein at least some of the plurality of micropillars are designed to have non-uniform heights, such that a difference between the heights of the at least some of the plurality of micropillars is greater than or equal to 10%.

7. The stator vane assembly of claim 1, wherein at least some of the plurality of micropillars are designed to have non-uniform stiffnesses, such that a difference between the stiffnesses of the at least some of the plurality of micropillars is greater than or equal to 10%.

8. The stator vane assembly of claim 1, wherein each micropillar has a height of less than 10 mm.

9. The stator vane assembly of claim 1, wherein the support member engages the at least one of the inner carrier and the outer carrier.

10. The stator vane assembly of claim 1, wherein the load transfer device further comprises a datum member at least partially enclosing the support member and the plurality of micropillars, the datum member comprising:
- a first portion disposed at least partially between the support member and the at least one of the inner carrier and the outer carrier, wherein the first portion engages the support member and the at least one of the inner carrier and the outer carrier, and wherein the first portion is fixedly attached to the at least one of the inner carrier and the outer carrier; and
- a second portion extending from the first portion and spaced apart from the ceramic-containing airfoil.

11. The stator vane assembly of claim 10, wherein the datum member is integral with or fixedly attached to the support member.

12. The stator vane assembly of claim 1, wherein an outer surface of the ceramic-containing airfoil comprises a planar surface portion engaging with the plurality of micropillars.

13. The stator vane assembly of claim 1, wherein the support member comprises:
- a base plate fixedly attached to the at least one of the inner carrier and the outer carrier; and
- an insert removably attached to the base plate, the plurality of micropillars being fixedly attached to and extending from the insert.

14. The stator vane assembly of claim 1, further comprising a plurality of the load transfer devices, wherein at least one load transfer device from the plurality of the load transfer devices is disposed between the ceramic-containing airfoil and the inner carrier, and wherein at least one other load transfer device from the plurality of the load transfer devices is disposed between the ceramic-containing airfoil and the outer carrier.

15. A turbine for a gas turbine engine having a rotational axis, the turbine comprising:
- a stator vane assembly comprising:
- an inner carrier comprising a metallic material;
- an outer carrier comprising a metallic material;
- a ceramic-containing airfoil that extends from the inner carrier to the outer carrier and is at least partially received by the inner carrier and the outer carrier; and
- a first load transfer device disposed between the ceramic-containing airfoil and at least one of the inner carrier and the outer carrier, the first load transfer device comprising:
  - a support member fixedly attached to the at least one of the inner carrier and the outer carrier; and
  - a plurality of micropillars coupled to the support member and extending towards the ceramic-containing airfoil, wherein each micropillar is deformable and engages the ceramic-containing airfoil;
  - a rotor blade axially spaced apart from the stator vane assembly with respect to the rotational axis; and
  - a turbine shroud assembly circumferentially encasing the rotor blade with respect to the rotational axis.

16. The turbine of claim 15, wherein the turbine shroud assembly comprises:
- a carrier segment comprising a metallic material;
- a ceramic-containing seal segment coupled to the carrier segment and facing the rotor blade; and
- a second load transfer device disposed between the carrier segment and the ceramic-containing seal segment, the second load transfer device comprising:

a support member fixedly attached to the carrier segment; and a plurality of micropillars coupled to the support member and extending towards the ceramic-containing seal segment, wherein each micropillar is deformable and engages the ceramic-containing seal segment.

17. The turbine of claim 16, further comprising a plurality of the second load transfer devices, wherein at least one second load transfer device from the plurality of the second load transfer devices is radially disposed between the carrier segment and the ceramic-containing seal segment with respect to the rotational axis, and wherein at least one other second load transfer device from the plurality of the second load transfer devices is axially disposed between the carrier segment and the ceramic-containing seal segment with respect to the rotational axis.

18. The turbine of claim 17, wherein the ceramic-containing seal segment further comprises a flange extending towards the carrier segment, the flange comprising:

one or more apertures for at least partially receiving one or more pins that couple the ceramic-containing seal segment to the carrier segment;

a radially outer surface facing the carrier segment; and an axial surface extending from the radially outer surface and facing the carrier segment;

wherein the at least one second load transfer device is radially disposed between the radially outer surface and the carrier segment with respect to the rotational axis, such that each micropillar of the at least one second load transfer device engages the radially outer surface; and wherein the at least one other second load transfer device is axially disposed between the axial surface and the carrier segment with respect to the rotational axis, such that each micropillar of the at least one other second load transfer device engages the axial surface.

* * * * *